US010900741B2

(12) United States Patent
Kielsmeier et al.

(10) Patent No.: US 10,900,741 B2
(45) **Date of Patent: *Jan. 26, 2021**

(54) FOLDABLE FIREARM

(71) Applicant: Magpul Industries Corp., Austin, TX (US)

(72) Inventors: Nicholas Kielsmeier, Denver, CO (US); Brian L. Nakayama, Arvada, CO (US); Jeremy M. Fiester, Lafayette, CO (US); Michael T. Mayberry, Denver, CO (US)

(73) Assignee: MAGPUL INDUSTRIES CORP., Austin, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/799,962

(22) Filed: Feb. 25, 2020

(65) Prior Publication Data

US 2020/0191520 A1 Jun. 18, 2020

Related U.S. Application Data

(60) Continuation of application No. 16/584,133, filed on Sep. 26, 2019, which is a division of application No.
(Continued)

(51) Int. Cl.
*F41A 3/72* (2006.01)
*F41C 23/04* (2006.01)
(Continued)

(52) U.S. Cl.
CPC ..... *F41C 23/04* (2013.01); *F41A 3/66* (2013.01); *F41A 3/72* (2013.01); *F41A 11/04* (2013.01);
(Continued)

(58) Field of Classification Search
CPC ..... F41A 7/02; F41A 3/72
(Continued)

(56) References Cited

U.S. PATENT DOCUMENTS 1,059,405 A 4/1913 Sprague
1,454,454 A 5/1923 Rosier
(Continued)

FOREIGN PATENT DOCUMENTS

CA 2970349 A1 6/2015
EP 1870660 B1 12/2008
(Continued)

OTHER PUBLICATIONS

Young, Lee W., "International Search Report and Written Opinion Regarding International Application No. PCT/US2018/66953", dated May 3, 2019, p. 15, Published in: WO.
(Continued)

*Primary Examiner* — Reginald S Tillman, Jr.
(74) *Attorney, Agent, or Firm* — Neugeboren O'Dowd PC

(57) ABSTRACT

The present disclosure describes a foldable firearm that collapses into a folded state under spring pressure. The foldable firearm may include a foldable grip assembly. The foldable grip assembly may include a foldable pistol grip, a foldable trigger assembly, a folding bar, and a foldable hand stop. The foldable grip assembly may fold into the top shell of the foldable firearm. The foldable firearm may also include an ambidextrous charging handle assembly that may include a bottom portion, a top portion, a guide bar, and two opposing charging handles. The charging handles may be pulled to unfold the foldable firearm, and/or butterflied such that pivoting one charging handle causes the other charging handle to pivot. The first-pivoted charging handle may then be pulled rearwards to unfold the firearm. The first-pivoted
(Continued)

charging handle may then be pulled further rearwards to rack the slide of the foldable firearm.

20 Claims, 41 Drawing Sheets

Related U.S. Application Data

16/228,600, filed on Dec. 20, 2018, now Pat. No. 10,443,971.

(60) Provisional application No. 62/610,731, filed on Dec. 27, 2017.

(51) Int. Cl.

| | |
|---|---|
| ***F41C 33/08*** | (2006.01) |
| ***F41A 35/06*** | (2006.01) |
| ***F41C 23/12*** | (2006.01) |
| ***F41A 3/66*** | (2006.01) |
| ***F41C 9/02*** | (2006.01) |
| ***F41A 11/04*** | (2006.01) |

(52) U.S. Cl.
CPC ..... *F41A 35/06* (2013.01); *F41C 9/02* (2013.01); *F41C 23/12* (2013.01); *F41C 33/08* (2013.01)

(58) Field of Classification Search
USPC ..... 89/1.4
See application file for complete search history.

(56) References Cited

U.S. PATENT DOCUMENTS

| | | | |
|---|---|---|---|
| 3,619,930 | A | 11/1971 | Beermann et al. |
| 3,979,850 | A | 9/1976 | Schiessl et al. |
| 4,271,623 | A | 6/1981 | Beretta |
| 4,299,046 | A | 11/1981 | Atchisson |
| 4,539,889 | A | 9/1985 | Glock |
| 4,625,621 | A | 12/1986 | Warin |
| 4,689,908 | A | 9/1987 | McClellan |
| 4,825,744 | A | 5/1989 | Glock |
| 4,893,546 | A | 1/1990 | Glock |
| 5,088,222 | A | 2/1992 | Larson |
| 5,293,708 | A | 3/1994 | Strayer et al. |
| 5,305,539 | A | 4/1994 | Kuster |
| 5,483,766 | A | 1/1996 | Hochstrate et al. |
| 5,669,169 | A | 9/1997 | Schmitter et al. |
| 5,671,560 | A | 9/1997 | Meller |
| 5,717,156 | A | 2/1998 | Lenkarski |
| 5,758,524 | A | 6/1998 | Yu |
| 6,212,812 | B1 | 4/2001 | Aigner |
| 6,234,058 | B1 | 5/2001 | Morgado |
| 6,234,059 | B1 | 5/2001 | Fuchs et al. |
| 6,253,479 | B1 | 7/2001 | Fuchs et al. |
| 6,257,116 | B1 | 7/2001 | Moczijdlower et al. |
| 6,260,301 | B1 | 7/2001 | Aigner et al. |
| 6,357,157 | B1 | 3/2002 | Constant et al. |
| 6,401,379 | B1 | 6/2002 | Moon |
| 6,421,944 | B1 | 7/2002 | Klebes et al. |
| 6,470,617 | B1 | 10/2002 | Gregory et al. |
| 6,513,273 | B2 | 2/2003 | da Silveira |
| 6,560,909 | B2 | 5/2003 | Cominolli |
| 6,718,680 | B2 | 4/2004 | Roca et al. |
| 6,789,342 | B2 | 9/2004 | Wonisch et al. |
| 6,843,013 | B2 | 1/2005 | Cutini |
| 6,865,979 | B1 | 3/2005 | Vaid |
| 7,204,051 | B2 | 4/2007 | Thomele et al. |
| 7,213,359 | B2 | 5/2007 | Beretta |
| 7,234,261 | B2 | 6/2007 | McGarry |
| 7,243,453 | B2 | 7/2007 | McGarry |
| 7,357,058 | B1 | 4/2008 | Olcott |
| 7,383,657 | B2 | 6/2008 | Pikielny |
| 7,472,507 | B2 | 1/2009 | Curry et al. |
| 7,600,340 | B2 | 10/2009 | Curry et al. |
| 7,703,230 | B2 | 4/2010 | Curry et al. |
| 7,726,059 | B2 | 6/2010 | Pikielny |
| 7,739,821 | B1 | 6/2010 | Hamme |
| 7,810,269 | B2 | 10/2010 | Zukowski et al. |
| 7,900,546 | B2 | 3/2011 | Bordson |
| 7,941,954 | B2 | 5/2011 | Carr et al. |
| 7,941,956 | B2 | 5/2011 | Carr et al. |
| 7,941,957 | B2 | 5/2011 | Carr et al. |
| 8,006,425 | B2 | 8/2011 | Burt et al. |
| 8,033,043 | B2 | 10/2011 | McGarry |
| 8,051,594 | B2 | 11/2011 | Carr et al. |
| 8,127,481 | B2 | 3/2012 | Rozum et al. |
| 8,132,496 | B2 | 3/2012 | Zukowski |
| 8,196,328 | B2 | 6/2012 | Simpkins |
| 8,266,998 | B1 | 9/2012 | Davis |
| 8,276,302 | B2 | 10/2012 | Zukowski |
| 8,333,028 | B1 | 12/2012 | Karfiol et al. |
| 8,356,537 | B2 * | 1/2013 | Kincel ..... F41A 3/72 42/16 |
| 8,448,366 | B2 | 5/2013 | Faifer |
| 8,464,455 | B2 | 6/2013 | Kallio |
| 8,468,732 | B2 | 6/2013 | Young |
| 8,539,871 | B1 | 9/2013 | Burt et al. |
| 8,567,301 | B1 | 10/2013 | Sharron |
| 8,650,789 | B2 | 2/2014 | Dionne et al. |
| 8,650,790 | B2 | 2/2014 | Dionne et al. |
| 8,661,722 | B2 | 3/2014 | Dionne et al. |
| 8,667,882 | B1 | 3/2014 | Larson et al. |
| 8,667,883 | B1 | 3/2014 | Larson et al. |
| 8,863,632 | B1 | 10/2014 | O'Malley |
| 8,887,432 | B2 | 11/2014 | Oz |
| 8,899,138 | B2 | 12/2014 | Brown |
| 8,935,871 | B2 | 1/2015 | Bardy |
| 8,960,066 | B2 | 2/2015 | Gomez |
| 8,997,620 | B2 | 4/2015 | Brown |
| 9,021,734 | B2 | 5/2015 | Voigt |
| 9,074,831 | B2 | 7/2015 | Glock |
| 9,188,400 | B2 | 11/2015 | Crouse |
| 9,222,738 | B2 | 12/2015 | Asher et al. |
| 9,239,207 | B2 | 1/2016 | Kresser |
| 9,273,927 | B2 | 3/2016 | Bondhus et al. |
| 9,291,416 | B2 | 3/2016 | Wurkner |
| 9,303,936 | B2 | 4/2016 | Toner |
| 9,377,260 | B2 | 6/2016 | Locher et al. |
| 9,383,153 | B2 | 7/2016 | Nebeker et al. |
| 9,441,897 | B2 | 9/2016 | Mather et al. |
| 9,448,023 | B2 | 9/2016 | Sheets, Jr. et al. |
| 9,733,030 | B2 | 8/2017 | Daniel et al. |
| 9,739,549 | B2 | 8/2017 | Kincel |
| 9,829,262 | B1 | 11/2017 | Suttie et al. |
| 9,835,411 | B2 | 12/2017 | Larson, Jr. et al. |
| 9,857,134 | B1 | 1/2018 | Karfiol et al. |
| 9,909,826 | B2 | 3/2018 | Kincel |
| 9,945,629 | B2 | 4/2018 | Osborne |
| 9,970,726 | B1 | 5/2018 | Hubert et al. |
| 10,006,728 | B2 | 6/2018 | Bailey |
| 10,012,461 | B2 | 7/2018 | Curry |
| 10,030,924 | B1 | 7/2018 | Smith |
| D832,388 | S | 10/2018 | McNally et al. |
| 10,113,822 | B1 | 10/2018 | Hobush |
| 10,126,079 | B2 | 11/2018 | Voigt |
| 10,151,556 | B2 | 12/2018 | Kjellberg |
| 10,274,276 | B2 | 4/2019 | Full |
| D849,869 | S | 5/2019 | Kielsmeier et al. |
| 10,352,635 | B2 | 7/2019 | Noonan |
| 10,371,474 | B2 | 8/2019 | Young |
| 10,393,456 | B1 | 8/2019 | Beardsley |
| 10,443,971 | B2 | 10/2019 | Kielsmeier et al. |
| 10,451,369 | B1 | 10/2019 | Lunt et al. |
| 10,488,132 | B2 | 11/2019 | Full |
| 10,612,887 | B1 * | 4/2020 | Kielsmeier ..... F41A 3/66 |
| 10,627,189 | B2 | 4/2020 | Faifer |
| 10,697,721 | B2 | 6/2020 | Kincel |
| 10,718,585 | B2 | 7/2020 | Ballard |
| 2008/0060247 | A1 | 3/2008 | Thomele et al. |
| 2009/0071053 | A1 | 3/2009 | Thomele et al. |
| 2009/0277066 | A1 | 11/2009 | Burt et al. |
| 2011/0107648 | A1 | 5/2011 | Tuz |

(56) References Cited

U.S. PATENT DOCUMENTS

| | | | | |
|---|---|---|---|---|
| 2012/0174454 | A1 | 7/2012 | Kallio | |
| 2012/0180647 | A1 | 7/2012 | Dublin | |
| 2013/0111795 | A1 | 5/2013 | Dionne et al. | |
| 2013/0111796 | A1 | 5/2013 | Dionne et al. | |
| 2013/0174457 | A1 | 7/2013 | Gangl et al. | |
| 2014/0060293 | A1* | 3/2014 | Gomez | F41A 35/06 89/1.4 |
| 2014/0075816 | A1 | 3/2014 | Larson et al. | |
| 2014/0150316 | A1 | 6/2014 | Acarreta | |
| 2016/0178298 | A1 | 6/2016 | Daniel et al. | |
| 2016/0187090 | A1 | 6/2016 | Mather et al. | |
| 2017/0045329 | A1 | 2/2017 | Turnington | |
| 2017/0131052 | A1 | 5/2017 | Voigt | |
| 2017/0356710 | A1 | 12/2017 | Full | |
| 2018/0142976 | A1 | 5/2018 | Full | |
| 2018/0195820 | A1 | 7/2018 | Noonan | |
| 2018/0224233 | A1 | 8/2018 | Macy | |
| 2018/0224234 | A1 | 8/2018 | Macy | |
| 2019/0033027 | A1 | 1/2019 | Voigt | |
| 2019/0041158 | A1 | 2/2019 | Kjellberg | |
| 2019/0170463 | A1 | 6/2019 | Walther et al. | |
| 2019/0257602 | A1 | 8/2019 | Reynolds | |
| 2019/0323795 | A1 | 10/2019 | Zimmer | |
| 2020/0080805 | A1 | 3/2020 | Headrick et al. | |
| 2020/0103191 | A1 | 4/2020 | Macy | |
| 2020/0191510 | A1 | 6/2020 | Sessions et al. | |
| 2020/0191514 | A1 | 6/2020 | Lee | |
| 2020/0191520 | A1 | 6/2020 | Kielsmeier et al. | |

FOREIGN PATENT DOCUMENTS

| | | | |
|---|---|---|---|
| EP | 2171389 | A | 4/2010 |
| EP | 2045561 | B1 | 12/2014 |
| EP | 2950033 | A1 | 12/2015 |
| EP | 2950033 | B1 | 11/2016 |
| EP | 3593079 | A1 | 1/2020 |
| WO | 9521366 | A1 | 8/1995 |
| WO | 2009048668 | A1 | 4/2009 |
| WO | 2009051872 | A2 | 4/2009 |
| WO | 2012018316 | A1 | 2/2012 |
| WO | 2012094493 | A1 | 7/2012 |
| WO | 2016125196 | A1 | 8/2016 |
| WO | 2017044589 | A1 | 3/2017 |
| WO | 2017136838 | A1 | 8/2017 |

OTHER PUBLICATIONS

Eger, Chris, "4 Folding Submachine Guns We'd Love to Get Our Hands on", Aug. 8, 2017, p. 3, Publisher: Retrieved from https://www.guns.com/news/2017/08/08/foldable-submachine-guns.

Wikipedia, "Magpul FMG-9", "Retrieved from https://en.wikipedia.org/wiki/Magpul_FMG-9", Known to exist as early as Dec. 12, 2017, p. 1.

NRA Museum, "Belgian Folding Trigger", "Known to exist as early as Apr. 30, 2020", p. 1.

Nicholas C., "Full Conceals Folding Glock Akin to Magpuls FMG9", Jul. 28, 2017, p. 7, Publisher: Retrieved from https://www.thefirearmblog.com/blog/2017/07/28/full-conceals-folding-glock-akin-magpuls-fmg9/.

Full Conceal, "M3D-Al Frame (Glock 19 Gen 3/4/5 Compatible)", "Known to exist as early as Apr. 23, 2020", p. 2, Publisher: Retrieved from https://www.fullconceal.com.

Full Conceal, "M3D Handgun (Based on Glock 19 Gen 4)", "Known to exist as early as Apr. 23, 2020", p. 1, Publisher: Retrieved from https://www.fullconceal.com.

Full Conceal, "M3D-S6 Bare Frame", "Known to exist as early as Apr. 30, 2020", Publisher: Retrieved from https://www.fullconceal.com.

Grab a Gun, "Full Conceal Viper With M3D Folding Glock Pistol 9mm 21RDS", "Known to exist as early as Apr. 30, 2020", p. 11, Publisher: https://grabagun.com/fc-viper-m3d-glock-19-9mm-21rd-blk.html.

Full Conceal, "M35 Handgun (Based on Glock 43)", "Known to exist as early as Apr. 23, 2020", p. 2, Publisher: Retrieved from https://www.fullconceal.com.

Yukari Nakamura, "International Preliminary Report on Patentability for International Application No. PCT/US2018/066953", dated Jul. 9, 2020, p. 7, Published in: CH.

Vining, Miles, "Thumb-Safety Glock", "Retrieved from https://www.forgottenweapons.com/thumb-safety-glock/", Known to exist as early as Jul. 30, 2020, p. 2.

Kirkpatrick, John, "Glock Manual Safety Kit by Cominolli Custom", "Retrieved from https://www.usacarry.com/glock-manual-safety-kit-by-cominolli-custom/", Mar. 17, 2011, p. 6.

Pete, "Uncovered: GEN5 Glock 22 With Manual Safety in Sao Paulo Brazil", Retrieved from https://www.thefirearmblog.com/blog/2018/01/19/gen5-glock-22-sao-paulo/, Jan. 19, 2018, p. 33.

Nicholas C, "A Closer Look At the Glock Thumb Safety", "Retrieved from https://www.thefirearmblog. ,mm/blog/2018/11/02/a-closer-look-at-the-glock-thumb-safety/", Nov. 2, 2018, p. 34.

White, Phil, "Breaking: New Glock 19 MHS 9mm and Glock 23 MHS .40 S and W Photos", "Retrieved from https://www.thefirearmblog.com/blog/2017/06/27/glock-19-mhs-23-mhs-photos/", Jun. 27, 2017, p. 23.

Premier Arms, "Glock Safety Kits", "Retrieved from premierarms.com/services/glock_safety_kits", Known to axist as early as Jul. 30, 2020, p. 7.

Tarnhelm Supply Co., Inc., "Glock Manual Safety", "Retrieved from www.tarnhelm.com/GlockSafety.html", Known to exist as early as Jul. 30, 2020, p. 2.

Ten-Ring Precision, Inc., "Glock Pistol Work", "Retrieved from https://tenring.com/glock-pistol-work-2/", Known to exist as early as Jul. 30, 2020, p. 6.

* cited by examiner

FOLDABLE FIREARM

CROSS REFERENCE TO RELATED APPLICATIONS

The present application for patent is a Continuation of U.S. patent application Ser. No. 16/584,133 entitled "FOLDABLE FIREARM" filed Sep. 26, 2019, pending, which is a Divisional of U.S. patent application Ser. No. 16/228,600 entitled "FOLDABLE FIREARM" filed Dec. 20, 2018 and issued as U.S. Pat. No. 10,443,971 on Oct. 15, 2019, which claims priority to U.S. Provisional Application No. 62/610,731, entitled "ARM BRACE FOR PISTOL," filed Dec. 27, 2017, the entire disclosure of which is hereby incorporated by reference for all proper purposes.

FIELD OF DISCLOSURE

The present disclosure relates generally to handheld firearms, and more specifically to a foldable handheld firearm which may include a charging handle assembly and/or a foldable grip assembly to enable folding and unfolding of the foldable firearm.

DESCRIPTION OF RELATED ART

Folding firearms such as MAGPUL'S FMG-9, the ARES/Warin Stealth Gun, UC-9 and M-21, PP-90 and Goblin are exemplary of folding handheld firearms. Historically these handled firearms were of a submachinegun design. These firearms utilized a folding cover as a butt stock providing shoulder support when deployed. Even if rudimentary as compared to typical rifle stocks, they provided stability and support during shooting especially during fully-automatic fire as would be typical of this type of firearm.

The FMG-9 included a charging handle that could be moved from one side of the firearm to the other to facilitate different-handedness. However, this process required some disassembly of the firearm.

SUMMARY

The following presents a simplified summary relating to one or more aspects and/or embodiments disclosed herein. As such, the following summary should not be considered an extensive overview relating to all contemplated aspects and/or embodiments, nor should the following summary be regarded to identify key or critical elements relating to all contemplated aspects and/or embodiments or to delineate the scope associated with any particular aspect and/or embodiment. Accordingly, the following summary has the sole purpose to present certain concepts relating to one or more aspects and/or embodiments relating to the mechanisms disclosed herein in a simplified form to precede the detailed description presented below.

Some embodiments of the invention may be characterized as a foldable firearm. The foldable firearm may comprise an ambidextrous charging handle assembly. The ambidextrous charging handle assembly may comprise a first and second charging handles which may be arranged on opposing sides of the ambidextrous charging handle assembly. In some embodiments, the first and second charging handles may be rotatably coupled such that a certain degree of rotation of one charging handle may cause rotation of the other charging handle. In some embodiments, the first and second charging handles may be rotatably coupled such that movement of either charging handle parallel to a longitudinal axis of the foldable firearm may cause the other charging handle to correspondingly move along the longitudinal axis of the foldable firearm. The first charging handle may comprise a large detent which may be on an upper interface level and a small detent which may be on a lower interface level. The second charging handle may comprise a small detent which may be on an upper interface level and a large detent which may be on a lower interface level. In some embodiments, the large detent of the first charging handle and the small detent of the second charging handle may interface when the first charging handle is rotated, which may cause the second charging handle to rotate to a lesser degree than the first charging handle. In some embodiments, the large detent of the first charging handle and the small detent of the second charging handle may interface when either of the charging handles is moved rearward such that both charging handles may move rearward in concert. In some embodiments, the large detent of the second charging handle and the small detent of the first charging handle may interface when either of the charging handles is moved rearward such that both charging handles may move rearward in concert. In some embodiments, the first charging handle may be oriented in a perpendicular orientation about the longitudinal axis of the firearm and the first charging handle may move towards the rear of the firearm which may cause the slide to move backwards towards a racked position. In some embodiments, the second charging handle may be oriented in a perpendicular orientation about the longitudinal axis of the firearm and the second charging handle may move towards the rear of the firearm which may cause the slide to move backwards towards a racked position.

The foldable firearm may comprise a slide racking assembly. In some embodiments, the slide racking assembly may be coupled to the first and second charging handles and may provide a first vertical pivot axis for the first charging handle and a second vertical pivot axis for the second charging handle. In some embodiments, the slide racking assembly may be configured to move parallel to the longitudinal axis of the foldable firearm in concert with the first and second charging handles. In some embodiments, the slide racking assembly may include one or more slide racking detents which may be shaped to engage a slide of the foldable firearm and may force the slide to move backward toward a racked position when the first or second charging handle is moved toward a rear of the ambidextrous charging handle assembly. In some embodiments, the first charging handle may be coupled to a bottom portion of the slide racking assembly by a first pivot nub. The first pivot nub may interface with a top portion of the slide racking assembly at a first pivot nub aperture. The interface may provide the first vertical pivot axis for the first charging handle. In some embodiments, the second charging handle may be coupled to the bottom portion of the slide racking assembly by a second pivot nub. The second pivot nub may interface with the top portion of the slide racking assembly at a second pivot nub aperture. The interface may provide the second vertical pivot axis for the second charging handle. In some embodiments, the bottom portion of the slide racking assembly may be coupled to the top portion of the slide racking assembly by a set of forward coupling protrusions of the bottom portion which may interface with a set of forward coupling recessions of the top portion. In some embodiments, the bottom portion of the slide racking assembly may be coupled to the top portion of the slide racking assembly by a set of rear coupling protrusions of the bottom portion which may interface with a set of rear coupling recessions of the top portion. In some embodiments, the slide racking assembly may be constrained to move parallel to the longitudinal axis of the firearm by a guide rail. The guide rail may be coupled to the firearm and may be positioned within a guide rail aperture of the top portion of the slide racking assembly. In some embodiments, the foldable firearm may be converted from a folded to an unfolded configuration by pivoting either the first or second charging handles which may be towards the rear end of the foldable firearm. The pivoting of the first charging handle may comprise pivoting the first charging handle from a forward-facing orientation to a non-forward-facing orientation less than, or equal to, a perpendicular orientation about the longitudinal axis of the firearm. The pivoting of the second charging handle may comprise pivoting the second charging handle from a forward-facing orientation to a non-forward-facing orientation less than, or equal to, a perpendicular orientation about the longitudinal axis of the firearm.

The foldable firearm may comprise a foldable grip assembly. The foldable grip assembly may comprise a foldable pistol grip. The foldable pistol grip may comprise a pistol grip-frame hinge axis. In some embodiments, the foldable pistol grip may be rotatably coupled to the frame of the foldable firearm at the pistol grip-frame hinge axis. The foldable pistol grip may comprise a rear part. The foldable pistol grip may comprise a folding part. The foldable pistol grip may comprise a pistol grip release button. In some embodiments, the rear part may be seperably coupled to the folding part and may be separated at a break away interface by actuating the pistol grip release button. The foldable grip assembly may comprise a foldable trigger. In some embodiments, the foldable trigger may be rotatably coupled to the frame of the foldable firearm at a trigger hinge axis. The foldable grip assembly may comprise a foldable trigger guard assembly. In some embodiments, the foldable trigger guard assembly may be rotatably coupled to the foldable pistol grip and the frame of the firearm. The foldable trigger guard assembly may comprise a bottom trigger guard. The foldable trigger guard assembly may comprise a forward trigger guard. The foldable trigger guard assembly may comprise a trigger guard-pistol grip hinge axis. In some embodiments, the bottom trigger guard may be rotatably coupled to the folding part of the foldable pistol grip at the trigger guard-pistol grip hinge axis. The foldable trigger guard assembly may comprise a trigger guard hinge axis. In some embodiments, the bottom trigger guard may be rotatably coupled to the forward trigger guard at the trigger guard hinge axis. The foldable trigger guard assembly may comprise a trigger guard-frame hinge axis. In some embodiments, the forward trigger guard may be rotatably coupled to the frame of the foldable firearm at the trigger guard-frame hinge axis. The foldable trigger guard assembly may comprise a trigger guard-folding bar hinge axis. The foldable grip assembly may comprise a hand stop. In some embodiments, the hand stop may be rotatably coupled to the frame of the foldable firearm at a hand stop-frame hinge axis. The foldable trigger guard assembly may comprise a folding bar. In some embodiments, the folding bar may be mechanically coupled to the trigger guard at the trigger guard-folding bar hinge axis and may be mechanically coupled to the hand stop at the hand stop-folding bar hinge axis.

The foldable grip assembly may be converted from an unfolded to a folded configuration. Converting the foldable grip from an unfolded to a folded configuration may comprise actuating the pistol grip release button. In some embodiments, actuating the pistol grip release button may separate the rear part from the folding part of the foldable trigger frame. Converting the foldable grip from an unfolded to a folded configuration comprise supplying a torqueing force about the pistol grip-frame hinge axis to the folding part of the pistol grip. In some embodiments, the folding part may supply a lateral force to the foldable trigger assembly, the folding bar, and the hand stop, which may cause the hand stop to rotate about the hand stop-frame hinge axis. In some embodiments, when converting the foldable grip assembly from an unfolded to a folded configuration, the folding part of the pistol grip may fold from a vertical to a horizontal orientation about the pistol grip-frame hinge axis, the bottom trigger guard may fold horizontally upwards about the pistol grip-trigger guard hinge axis and the trigger guard hinge axis, the forward trigger guard may fold vertically upwards about the trigger guard hinge axis and the trigger guard-frame hinge axis, the foldable trigger may rotate upwards about the trigger hinge axis, the folding bar may move laterally forward about the trigger guard-folding bar axis and the hand stop-folding bar hinge axis, and the hand stop may rotate inwards about the hand stop-folding bar axis and the hand stop-frame hinge axis.

DETAILED DESCRIPTION

Figure 1:
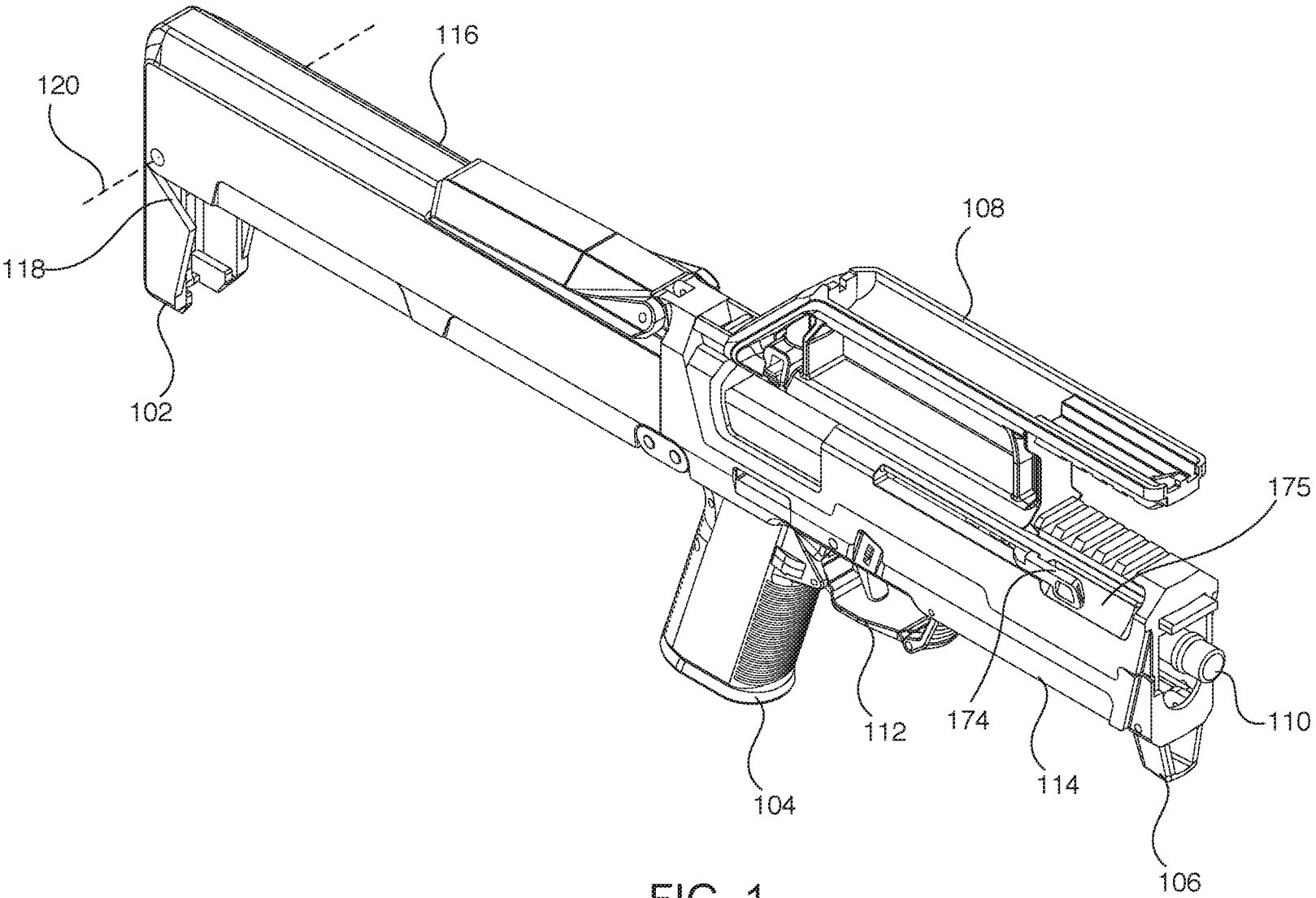
FIG. 1 illustrates a right-side view of a first embodiment of a foldable firearm in an unfolded configuration.

An arm brace design is disclosed to take the place of a butt stock in a folding firearm. Additionally, a compact, ambidextrous charging handle mechanism is disclosed. Additionally, a foldable grip assembly is disclosed.

The words "for example" and "exemplary" are used herein to mean "serving as an example, instance, or illustration." Any embodiment described herein as "for example" or "exemplary" is not necessarily to be construed as preferred or advantageous over other embodiments.

Preliminary note: the flowcharts and block diagrams in the following Figures illustrate the architecture, functionality, and operation of possible implementations of systems, methods and computer program products according to various embodiments of the present invention. In this regard, some blocks in these flowcharts or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustrations, and combinations of blocks in the block diagrams and/or flowchart illustrations, can be implemented by special purpose hardware-based systems that perform the specified functions or acts, or combinations of special purpose hardware and computer instructions.

Foldable Grip Assembly:

FIGS. 4, 26, 27, 28, and 41 illustrate a foldable grip assembly of foldable firearm 100. Regarding FIGS. 26, 27, 28, and 41, bottom shell 116 and of the foldable firearm 100 has been hidden to reveal the inner parts when the firearm is folded. Portions of the top shell 114 have also been removed to aid in visibility of the inner workings of the firearm.

The foldable grip assembly of foldable firearm 100 may comprise a foldable pistol grip 104, a foldable trigger 134, a foldable trigger guard assembly 112, a folding bar 142, and a hand stop 106. The foldable grip assembly may fold from an unfolded to a folded configuration by the coupling of foldable pistol grip 104, foldable trigger 134, foldable trigger guard assembly 112, and hand stop 106.

Figure 4:
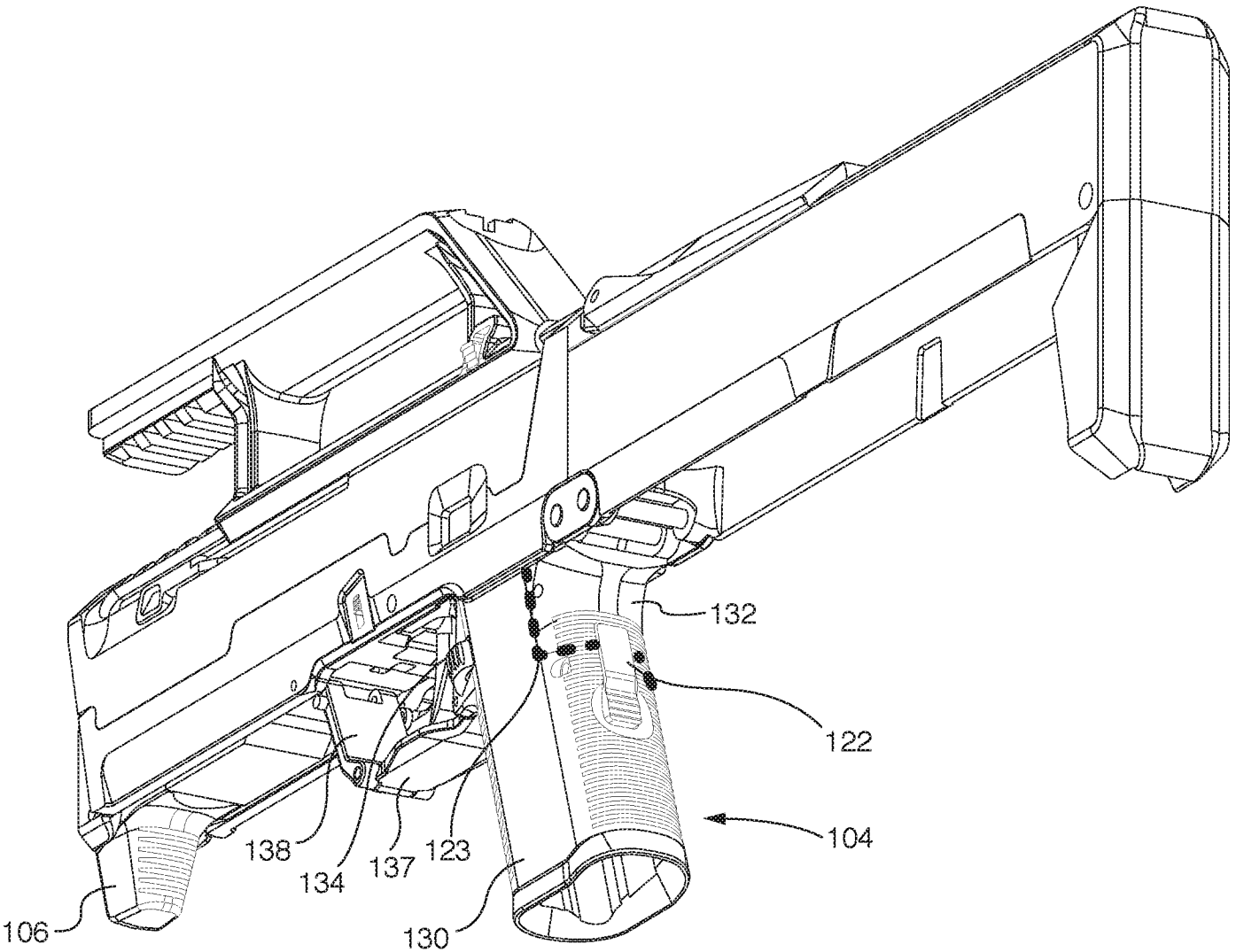
FIG. 4 illustrates a left side view of a first embodiment of a foldable firearm in an unfolded configuration.
Figure 26:
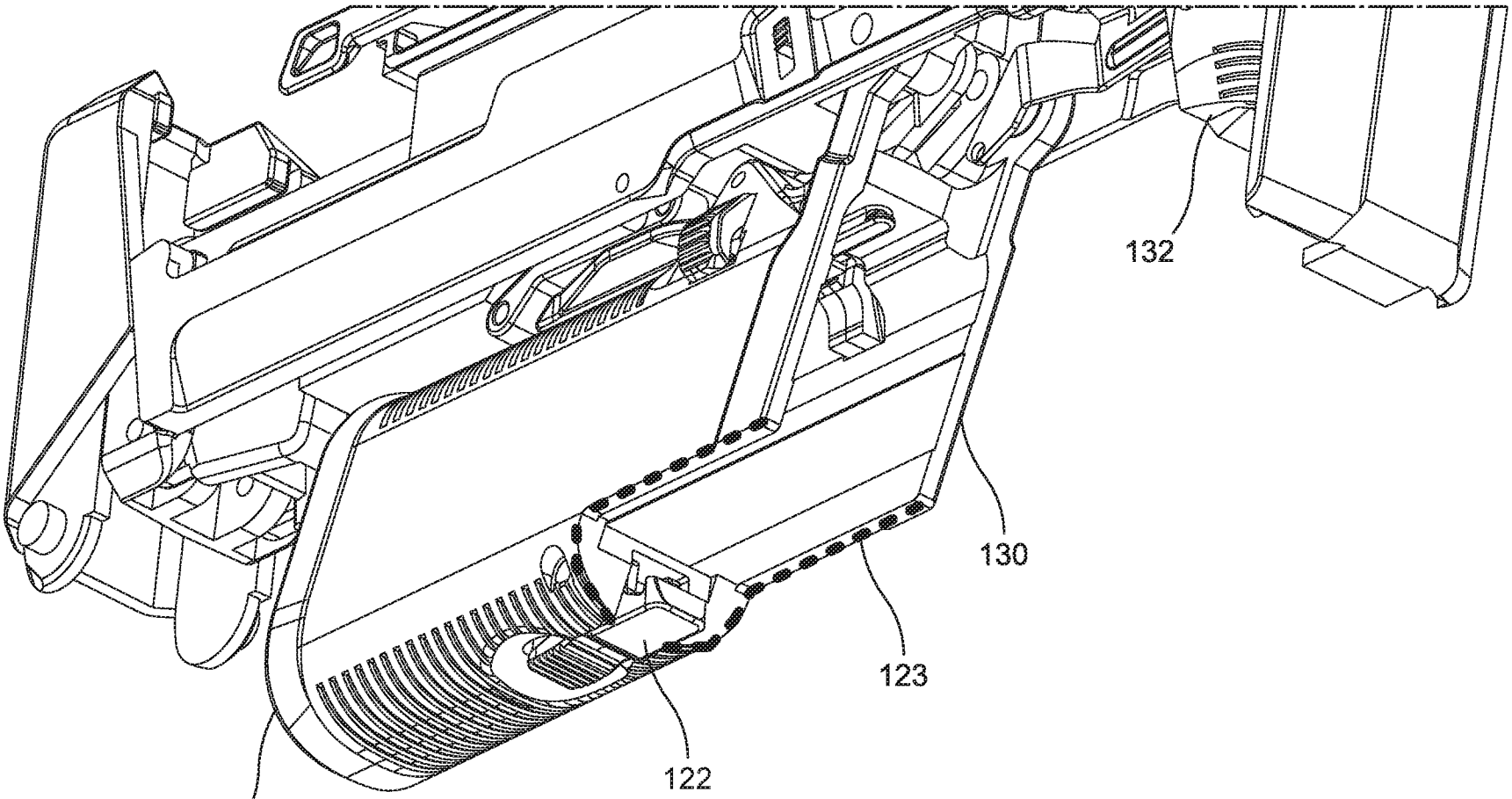
FIG. 26 illustrates a bottom right side view of a first embodiment of a foldable firearm with the bottom half of the foldable firearm hidden illustrating a foldable grip assembly.
Figure 27:
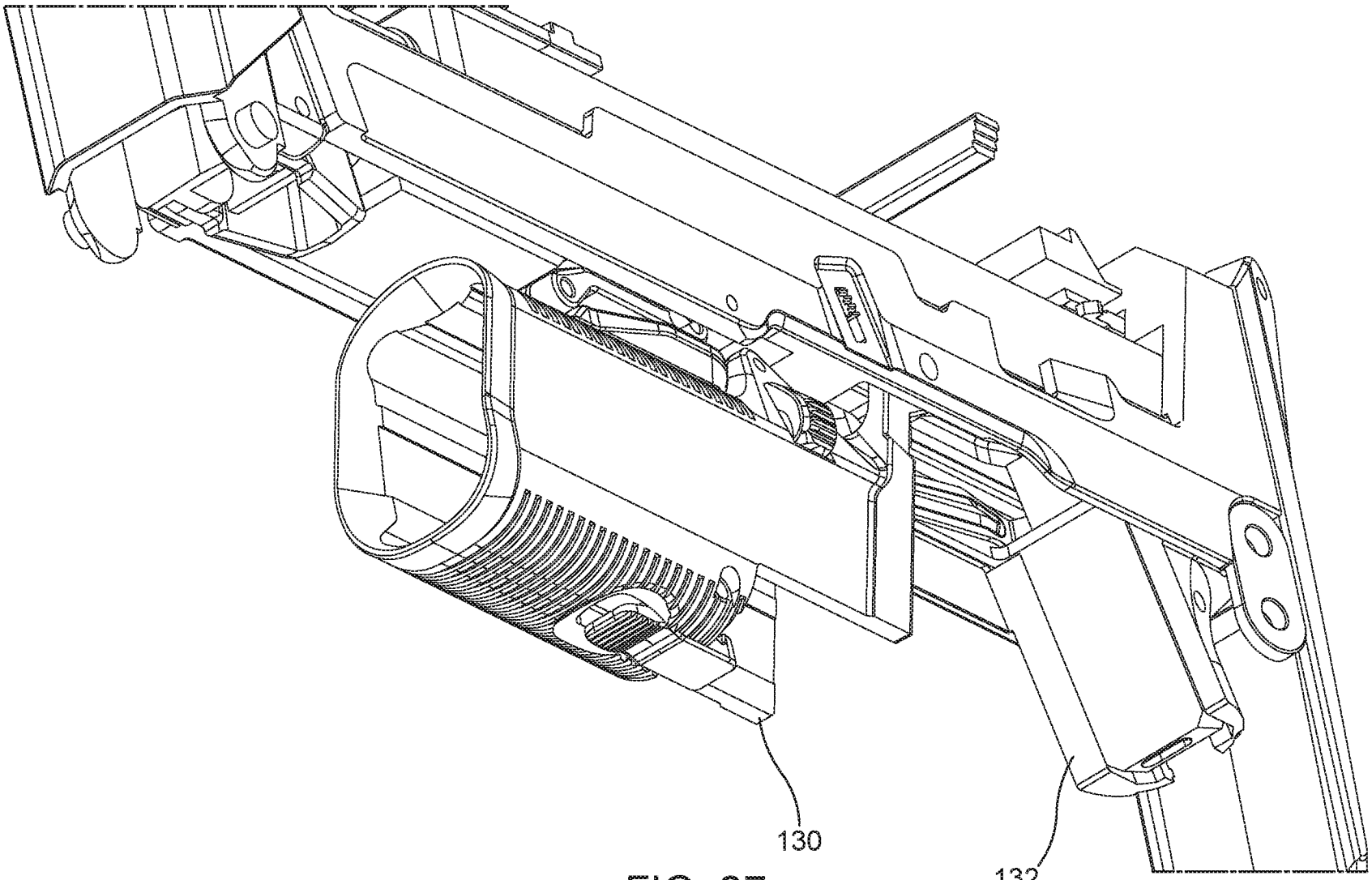
FIG. 27 illustrates a bottom left side view of a first embodiment of a foldable firearm with the bottom half of the foldable firearm hidden illustrating a foldable grip assembly.
Figure 41:
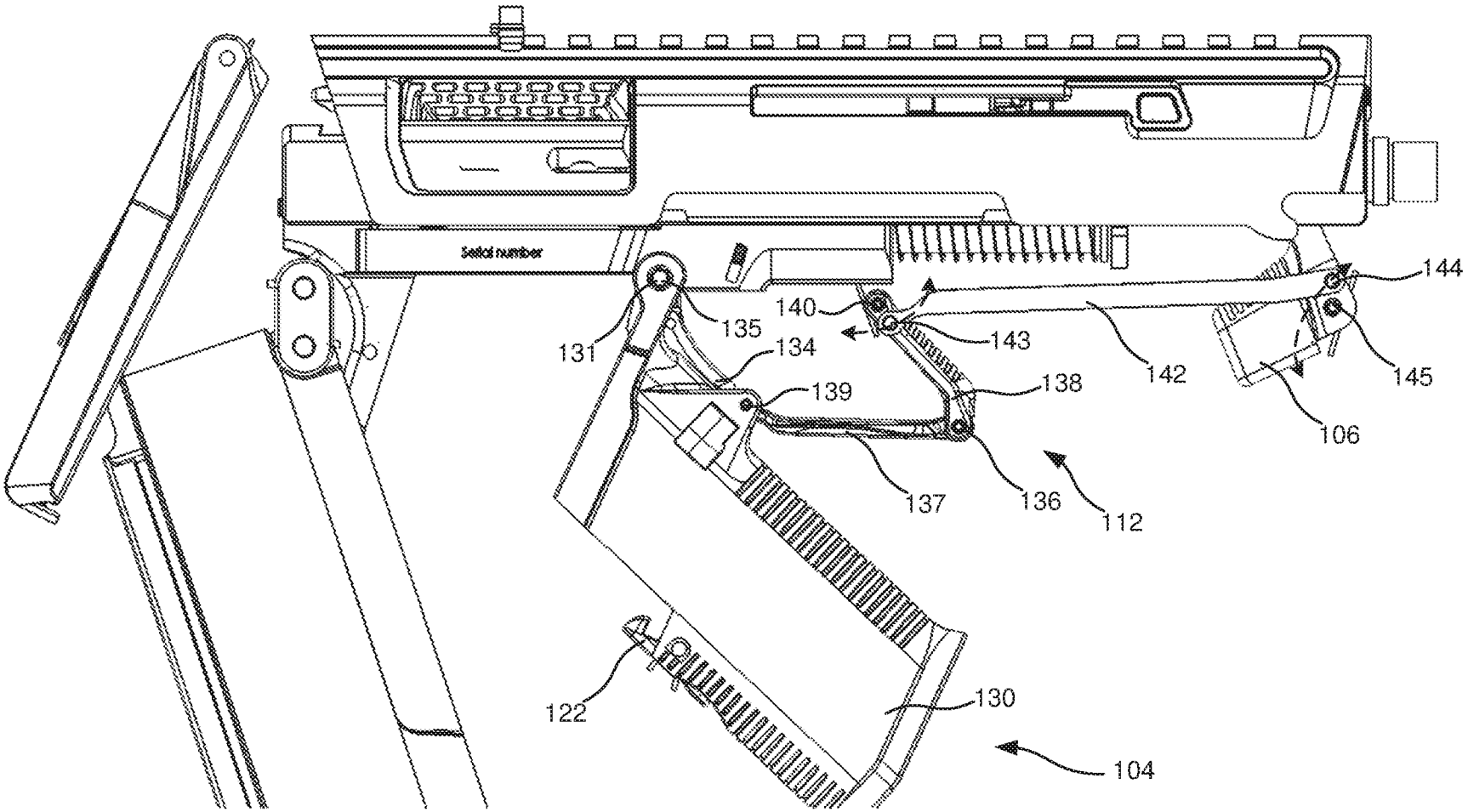
FIG. 41 illustrates a right-side view of a foldable grip assembly of a foldable firearm.

FIG. 4 illustrates foldable pistol grip 104 in an unfolded orientation. In some embodiments, foldable pistol grip 104 may be regarded as being substantially similar to a traditional pistol grip, however, foldable pistol grip 104 may be rotatably coupled to foldable firearm 100 and fold into a folded configuration as illustrated in FIGS. 26 and 27. Foldable pistol grip 104 may further comprise rear part 132, folding part 130, and pistol grip release button 122. As illustrated in FIG. 4, rear part 132 may be seperably coupled to folding part 130. In some embodiments, when pistol grip release button 122 is actuated, rear part 132 may separate from folding part 130 about break away interface 123. This may enable the collapse of foldable pistol grip 104. FIG. 26. illustrates an exemplary view of such a collapsed orientation of foldable pistol grip 104 wherein rear part 132 and folding part 130 are visibly separated about break away interface 123. FIG. 27 illustrates an additional exemplary collapsed orientation of foldable pistol grip 104 wherein rear part 132 and folding part 130 are visibly separated. FIG. 41. illustrates an exemplary folding view of foldable pistol grip 104. Once detached from rear part 132, folding part 130 may pivot about pistol grip-frame hinge axis 131 from a substantially vertical orientation, as illustrated in FIG. 4, to a substantially horizontal orientation, as illustrated in FIGS. 26 and 27. Foldable pistol grip 104 may comprise a variety of materials including polymeric material, metal, composite, ceramic, or other suitable materials.

Figure 28:
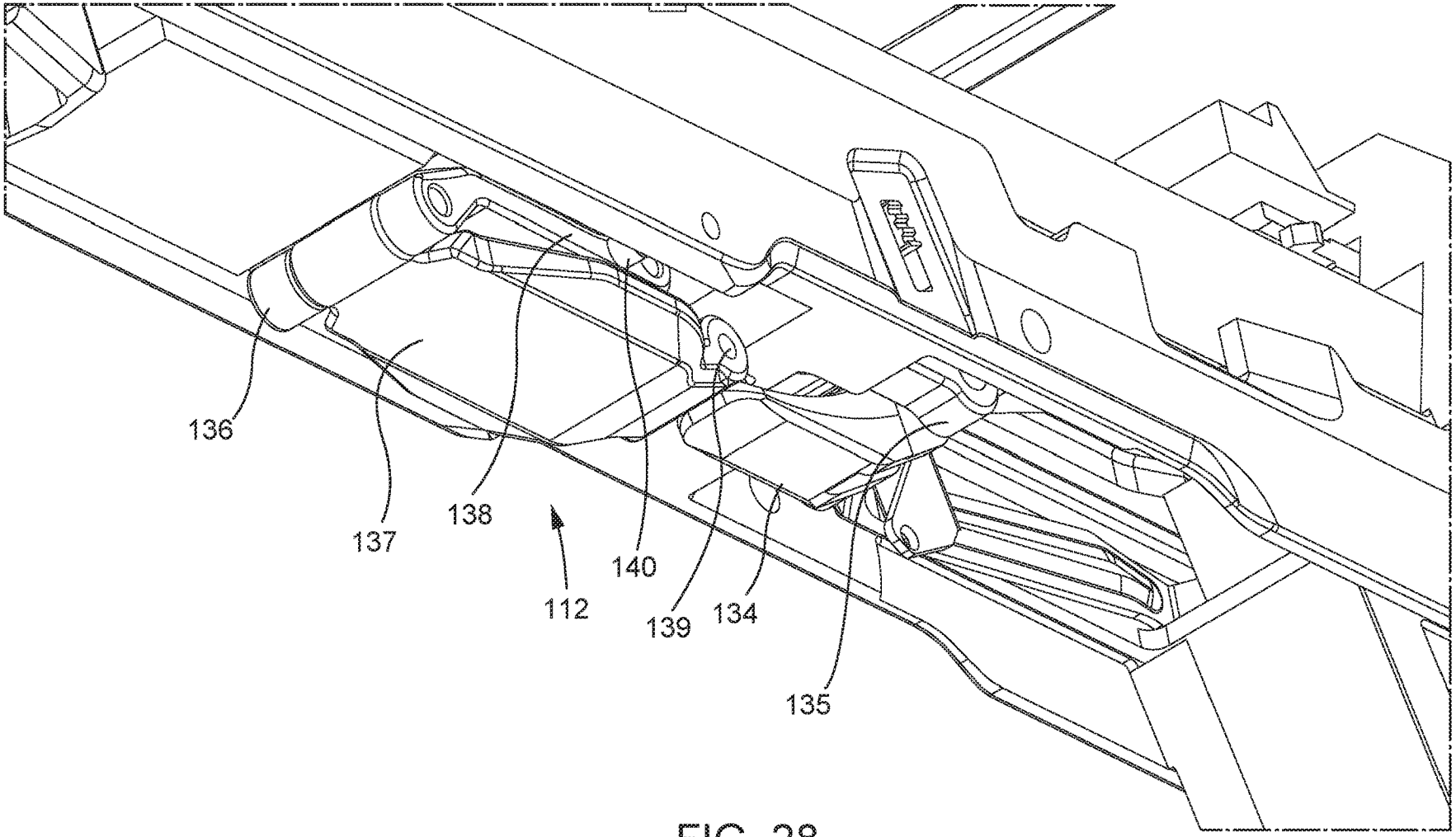
FIG. 28 illustrates a bottom left side view of a first embodiment of a foldable firearm with the bottom half and the foldable pistol grip of the foldable firearm hidden illustrating the foldable trigger and foldable trigger guard assembly of the foldable grip assembly.

A foldable trigger 134 may also be seen in FIG. 41 where it is being folded from a substantially vertical orientation, as illustrated in FIG. 4, to a substantially horizontal orientation as illustrated in FIG. 28. Foldable trigger 134 may pivot towards the front end of foldable firearm 100 about trigger hinge axis 135 into a folded configuration. The folding part 130, when collapsing, may supply lateral force to foldable trigger 134 such that when folding part 130 pivots about pistol grip-frame axis 131, so too does foldable trigger 134 about trigger hinge axis 135. Foldable pistol grip 104 may comprise a variety of materials including polymeric material, metal, composite, ceramic, or other suitable materials.

FIG. 41 also illustrates the foldable trigger guard assembly 112, which may include bottom trigger guard 137, and forward trigger guard 138. The foldable trigger guard assembly 112 may be coupled to the foldable pistol grip and top part 114 of the frame of the firearm such. In some embodiments, bottom trigger guard 137 may be regarded as the bottom section of foldable trigger guard assembly 138 in which foldable trigger 134 is positioned above. Bottom trigger guard 137 may be oriented horizontally about the longitudinal axis of the foldable firearm 100, as illustrated in FIG. 4. Bottom trigger guard 137 may be coupled to folding part 130 of foldable pistol grip 104 at trigger guard-pistol grip hinge axis 139. In some embodiments, when folding part 130 is detached from rear part 132 of foldable pistol grip 112 and moved towards a folded configuration, bottom part 137 may pivot about trigger guard-pistol grip axis 139 and move horizontally forwards and vertically upwards to a folded state, as illustrated in FIG. 28. Bottom trigger guard 137 may be coupled to front trigger guard 138 by trigger guard hinge axis 136. Trigger guard hinge axis 136 may allow both bottom trigger guard 137 and front trigger guard 138 to pivot about trigger guard hinge axis 136 from an unfolded configuration, as illustrated in FIG. 4, to a substantially flat, folded configuration, as illustrated in FIG. 28. In some embodiments, front trigger guard 138 may be regarded as the front part of trigger guard assembly 112 wherein foldable trigger 134 is positioned horizontally behind. Front trigger guard 138 may be oriented substantially vertically about the longitudinal axis of foldable firearm 100, as illustrated in FIG. 4. Front trigger guard 138 may be coupled to top shell 114 of the foldable firearm 100 by trigger guard-frame hinge axis 140. In some embodiments, when folding part 130 is detached from rear part 132 of foldable pistol grip 104 and moved towards a folded configuration, front part 138 may pivot about trigger guard-frame hinge axis 140 since front trigger guard 138 is rotatably coupled to bottom trigger guard 137 by trigger guard hinge axis 136. The pivoting may cause front trigger guard 138 to move vertically upwards and horizontally inwards about foldable firearm 100 to a folded configuration. Foldable trigger guard assembly 112 may comprise a variety of materials including polymeric material, metal, composite, ceramic, or other suitable materials.

The trigger guard assembly 112 may be coupled to the hand stop 106 via a folding bar 142. In some embodiments, folding bar 142 may be regarded as a longitudinal member which transfers horizontal force about the folded firearm to collapse hand stop 106 in conjunction with the folding of foldable pistol grip 104, foldable trigger 134, and foldable trigger guard assembly 112. Folding bar 142 may be rotatably coupled to front trigger guard 138 at trigger guard-folding bar hinge axis 143. In some embodiments, when front trigger guard 138 is folded upwards into a folded configuration, folding bar 142 pivots about trigger guard-folding bar hinge axis 143 such that folding bar 142 moves horizontally and vertically about foldable firearm 100 into a folded position. Folding bar 142 may comprise a variety of materials including polymeric material, metal, composite, ceramic, or other suitable materials.

The foldable firearm 100 can include a hand stop 106, that in some embodiments, may be regarded as a forward hand stop of foldable firearm 100 that may prevent forward motion of the user's hand during firing. Hand stop 106 may be coupled to top shell 114 of foldable firearm 100 by hand stop-frame hinge axis 145. Hand stop 106 may also be coupled to folding bar 142 by hand stop-folding bar hinge axis 144. In some embodiments, when folding bar 142 moves in a horizontal and vertical direction into a collapsed position (see dashed arrows at axis 143 and axis 144), hand stop 106 pivots about hand stop-folding bar hinge axis 144, which in turn causes hand stop 106 to pivot inwards about hand stop-frame hinge axis 145 to a folded position (see FIGS. 26-28). The top shell 114 can include an opening to receive at least a portion of the hand stop 106 when it folds up and into the opening of the top shell 114. Hand stop 106 may comprise a variety of materials including polymeric material, metal, composite, ceramic, or other suitable materials.

The foldable grip assembly of foldable firearm 100 may change from a folded to an unfolded configuration. For example, depressing release button 122 can unlock folding part 130 from rear part 132 of foldable pistol grip 104. Providing a torqueing force about pistol grip-frame hinge axis 131 by pushing forward on the bottom half of folding part 130 causes the folding part 130 to rotate forward. The forward rotation of folding part 130 causes foldable trigger 134 to pivot forward and upward about trigger hinge axis 135. Foldable trigger guard assembly 112 is connected to folding part 130 by trigger guard-pistol grip hinge axis 139 and begins to pivot forward and upward with folding part 130. Forward trigger guard 138 begins to fold upwards as bottom trigger guard 137 folds upwards since the two trigger guard pieces are connected by trigger guard hinge axis 136. As forward trigger guard 138 folds upwards about trigger guard-frame hinge axis 140, folding bar 142 moves in an arcuate manner forwards and upwards into a folded state. Due to hand stop 106 being coupled to folding bar 142 by hand stop-folding bar hinge axis 144, hand stop 106 begins to rotate back and upwards about hand stop-frame hinge axis 145. This folding continues until folding part 130 of foldable pistol grip 104 is in a substantially perpendicular orientation to the longitudinal axis of the foldable firearm 100, the folding part 130 resting inside bottom shell 116 of foldable firearm 100. In this folded orientation, foldable pistol grip 104, foldable trigger 134, foldable trigger guard assembly 112, and hand stop 106 are all folded substantially flat in a horizontal orientation to the longitudinal axis of foldable firearm 100.

Figure 2:
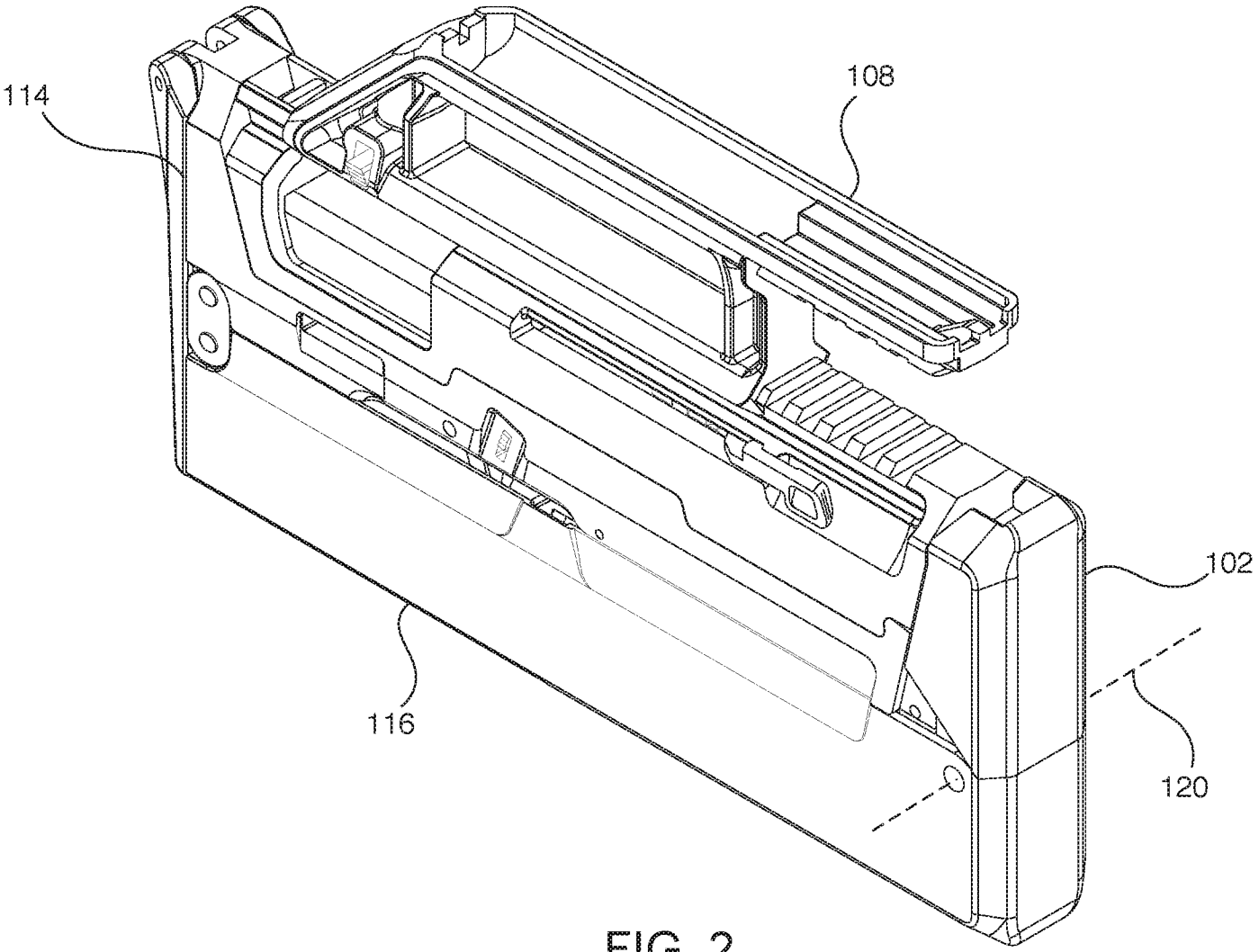
FIG. 2 illustrates a right-side view of a first embodiment of a foldable firearm in a folded configuration.

Charging Handle Assembly:

FIGS. 30 through 40 illustrate an ambidextrous charging handle assembly 170 of foldable firearm 100. Regarding FIGS. 30, 31, 32, and 39, top shell 114 of foldable firearm 100 has been partially hidden. Ambidextrous charging handle assembly 170 may deploy the foldable firearm 100 from a folded configuration, as illustrated in FIG. 2, to an unfolded configuration, as illustrated in FIG. 4. Additionally, ambidextrous charging handle assembly 170 may rack slide 150 of foldable firearm 100 to charge foldable firearm 100 with ammunition.

Figure 31:
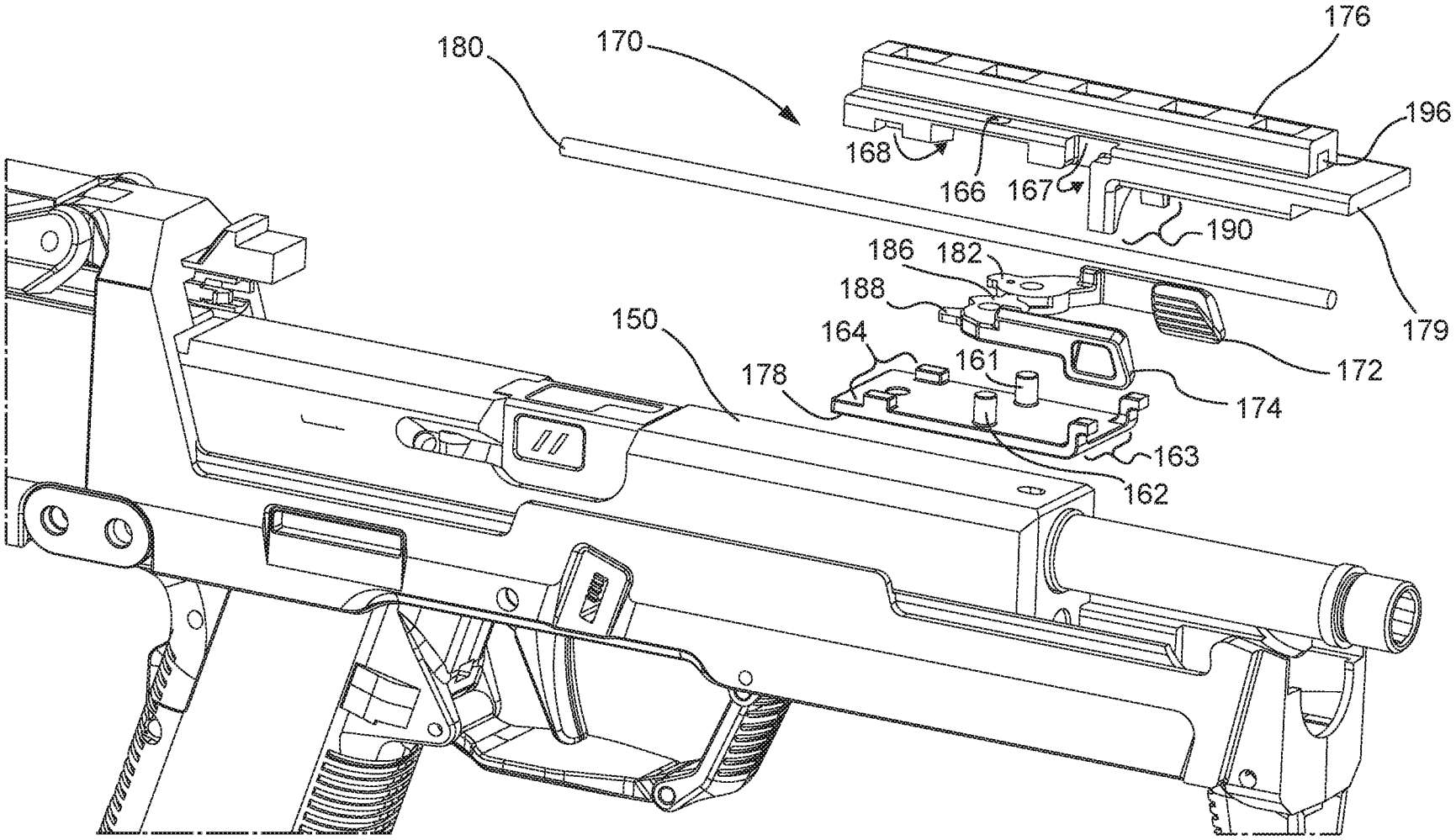
FIG. 31 illustrates a right-side view of an exploded charging handle assembly of a foldable firearm.
Figure 32:
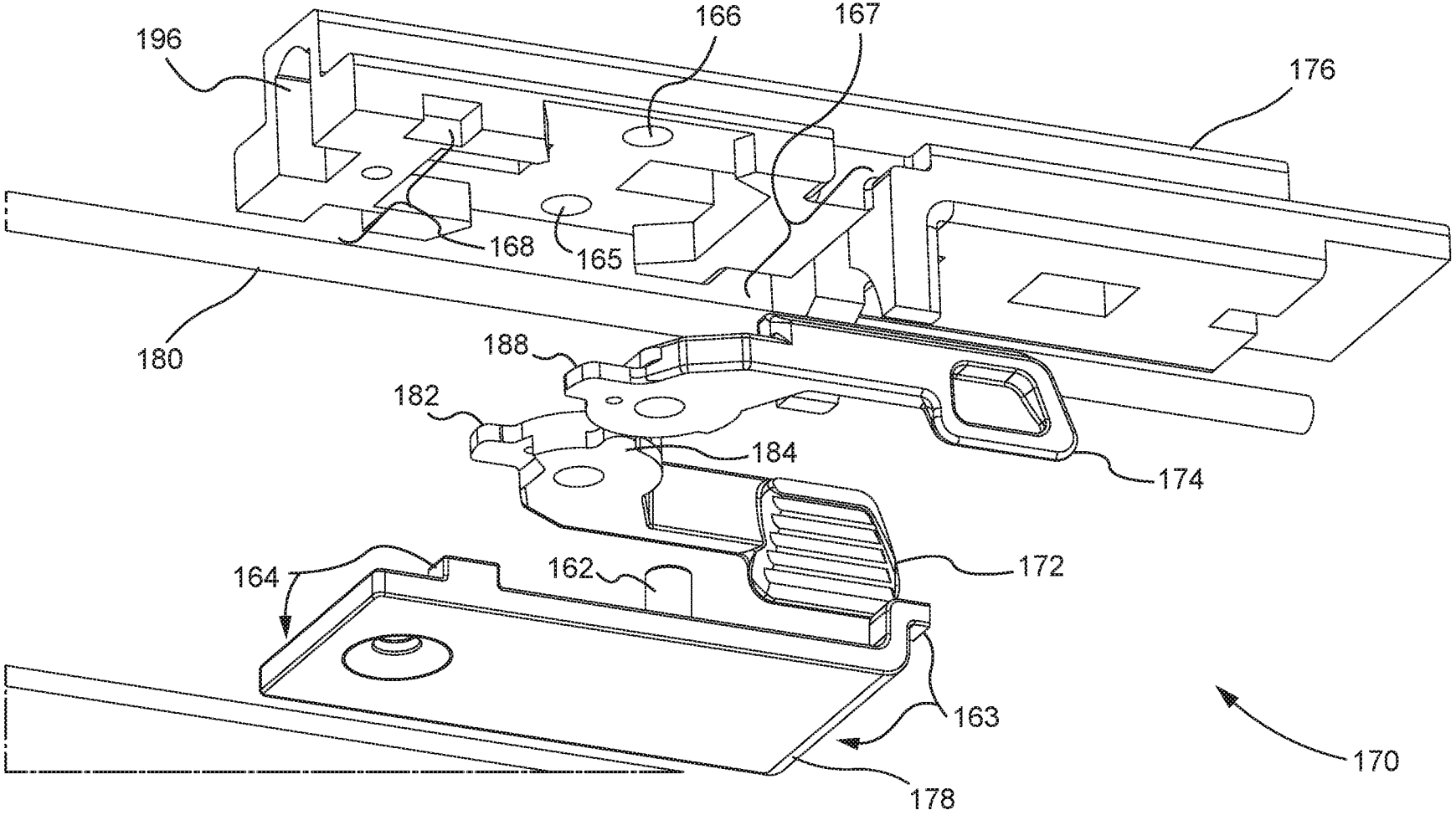
FIG. 32 illustrates a right bottom view of an exploded charging handle assembly of a foldable firearm.

FIGS. 31 and 32 illustrate exploded views of charging handle assembly 170 of foldable firearm 100 with portions of the top shell 114 hidden. Charging handle assembly 170 may comprise bottom portion 178, top portion 176, first charging handle 172, second charging handle 174, and guide rail 180. Bottom portion 178 may be regarded as the bottom part of ambidextrous charging handle assembly 170. Bottom portion 178 may be a tetrahedral (e.g., rectangular) geometry, however, in some embodiments, other geometries may be used. Bottom portion 178 may have a bottom side that may be flat and may be oriented such that it rests just above and not in contact with the slide 150. For instance, the charging handle assembly 170 may hang from the rail 180 such that the bottom portion 178 does not contact the slide 150. Bottom portion 178 may comprise a pair of forward coupling protrusions 163, a pair of rear coupling protrusions 164, a first pivot nub 161, and a second pivot nub 162. Bottom portion 178 may comprise a variety of materials including polymeric material, metal, composite, ceramic, or other suitable materials.

The pair of forward coupling protrusions 163 may be protrusions that protrude from the top side of bottom portion 178 in a vertically upward direction and may intersect with the pair of forward coupling recessions 167 of the top portion 176 of ambidextrous charging handle assembly 170. Such an intersection may provide coupling such that top portion 176 and bottom portion 178 are structurally rigid whereas ambidextrous charging handle assembly 170 may be regarded as a single structure.

The pair of rear coupling protrusions 164 may protrude from the top side of bottom portion 178 in a vertically upward direction and may intersect with the pair of rear coupling recessions 168 of the top portion 176 of ambidextrous charging handle assembly 170. Such an intersection may provide coupling such that top portion 176 and bottom portion 178 is structurally rigid whereas ambidextrous charging handle assembly 170 may be regarded as a single structure.

First pivot nub 161 may be a cylindrical protrusion that protrudes from the top side of bottom portion 178 in a vertically upward direction and may intersect with first pivot nub aperture 165 of top portion 176 of ambidextrous charging handle assembly 170. The intersection of first pivot nub 161 and first pivot nub aperture 165 may create a first pivot axis about which first charging handle 172 may pivot.

Second pivot nub 162 may be a cylindrical protrusion that protrudes from the top side of bottom portion 178 in a vertically upward direction and may intersect with second pivot nub aperture 166 of top portion 176 of ambidextrous charging handle assembly 170. The intersection of second pivot nub 162 and first pivot nub aperture 166 may create a second pivot axis about which first charging handle 172 may pivot.

FIGS. 31 and 32 illustrate top portion 176. Top portion 176 may be regarded as the top part of ambidextrous charging handle assembly 170. Top portion 176 may be a tetrahedral geometry (e.g., rectangular), however, in some embodiments, other geometries may be used. Top portion 176 may comprise a pair of forward coupling recessions 167, a pair of rear coupling recessions 168, a first pivot nub aperture 165, a second pivot nub aperture 166, a guide rail aperture 196, a tab 179, and slide racking detents 190. Top portion 178 may comprise a variety of materials including polymeric material, metal, composite, ceramic, or other suitable materials.

The pair of forward coupling recessions 167 may be recessions that recess into the bottom side of top portion 176 in a vertically upward direction and may intersect with the pair of forward coupling protrusions 163 of the bottom portion 178 of ambidextrous charging handle assembly 170. Such an intersection may provide coupling such that the top portion 176 and bottom portion 178 are structurally rigid whereas ambidextrous charging handle assembly 170 may be regarded as a single structure. The pair of rear coupling recessions 168 may be recessions that recess into the bottom side of top portion 176 in a vertically upward direction and may intersect with the pair of rear coupling protrusions 164 of the bottom portion 178 of ambidextrous charging handle assembly 170. Such an intersection may provide coupling such that top portion 176 and bottom portion 178 are structurally rigid whereas ambidextrous charging handle assembly 170 may be regarded as a single structure.

First pivot nub aperture 165 may be a cylindrical recession that recesses into the bottom side of top portion 176 in a vertically upward direction and may intersect with first pivot nub 161 of bottom portion 178 of ambidextrous charging handle assembly 170. The intersection of first pivot nub 161 and first pivot nub aperture 165 may create a first pivot axis about which first charging handle 172 may pivot.

Second pivot nub aperture 166 may be a cylindrical recession that recesses into the bottom side of top portion 176 in a vertically upward direction and may intersect with second pivot nub 162 of bottom portion 178 of ambidextrous charging handle assembly 170. The intersection of second pivot nub 162 and second pivot nub aperture 166 may create a second pivot axis about which second charging handle 174 may pivot.

Guide rail aperture 196 may be regarded as an aperture which penetrates top portion 168 in a horizontal orientation parallel to the foldable firearm 100's longitudinal axis and runs from the front to the back of top portion 176. Guide rail aperture 196 may be a cylindrical aperture but may also be a hexagonal aperture, or an aperture of other geometries in some embodiments. Guide rail aperture 196 may receive guide rail 180. Guide rail aperture 196 may provide a sliding plane about which ambidextrous charging handle assembly 170 moves horizontally parallel to the longitudinal axis of foldable firearm 100. The sliding of ambidextrous charging handle assembly 170 may unfold and rack foldable firearm 100.

Figure 5:
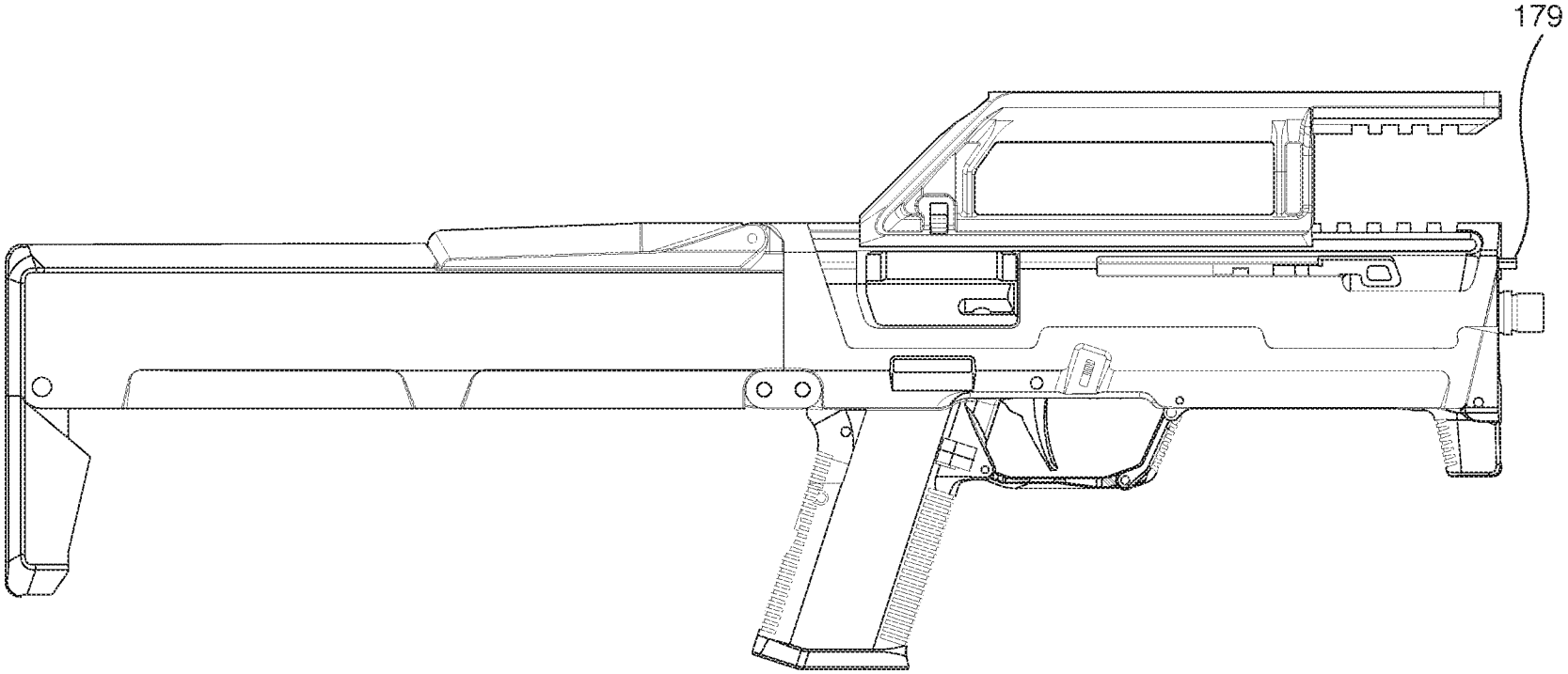
FIG. 5 illustrates an additional right-side view of a first embodiment of a foldable firearm in an unfolded configuration exemplifying a tab of a foldable firearm.
Figure 6:
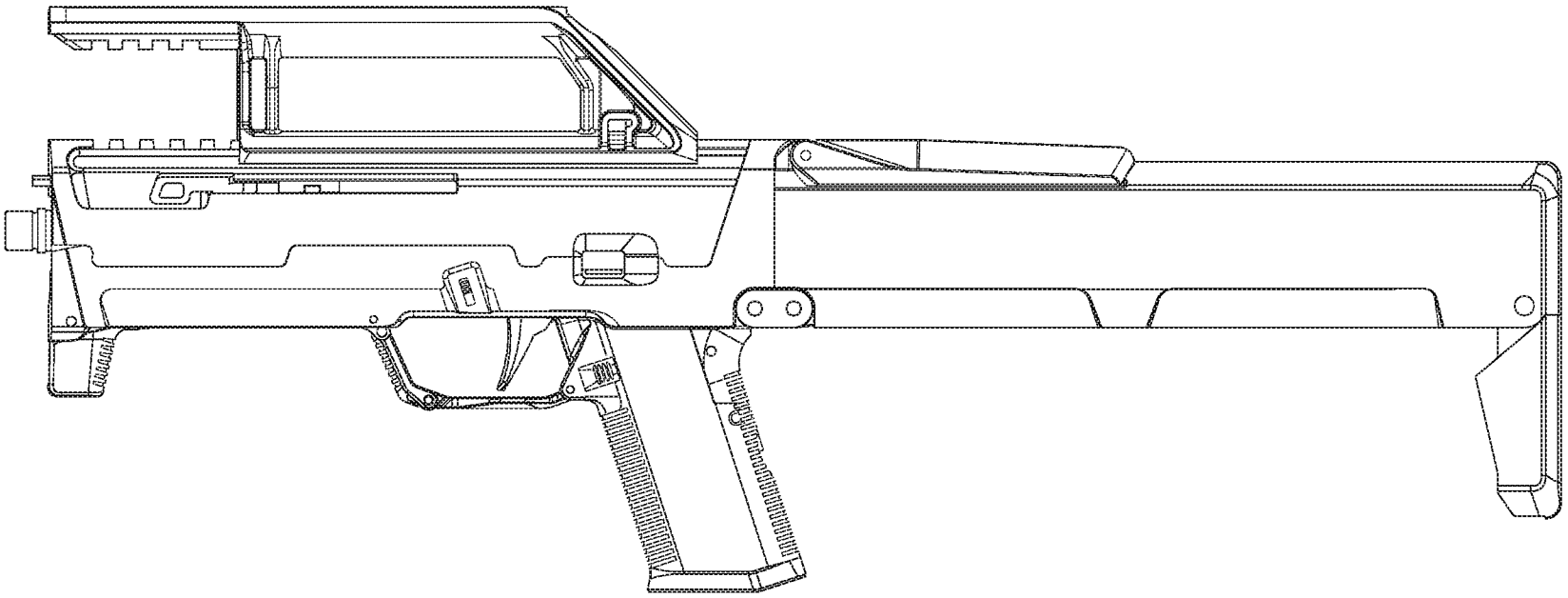
FIG. 6 illustrates an additional left side view of a first embodiment of a foldable firearm in an unfolded configuration.
Figure 7:
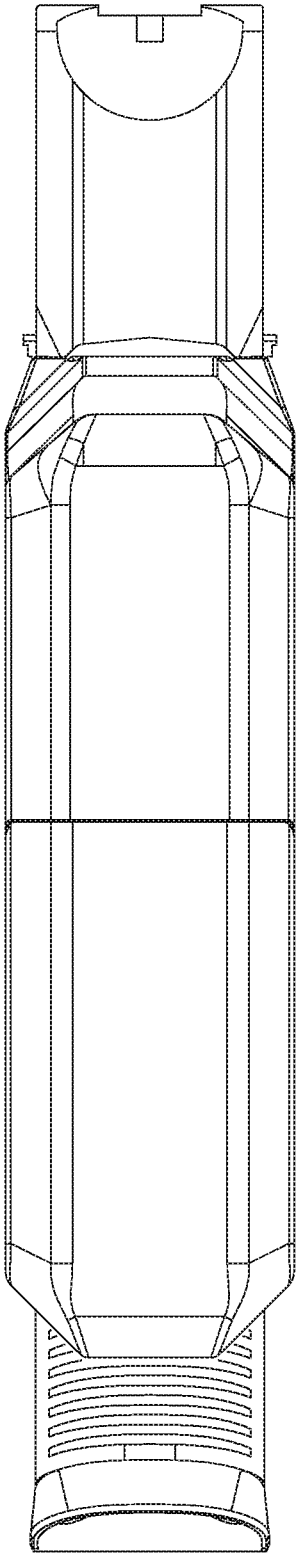
FIG. 7 illustrates a rear view of a first embodiment of a foldable firearm in an unfolded configuration.
Figure 8:
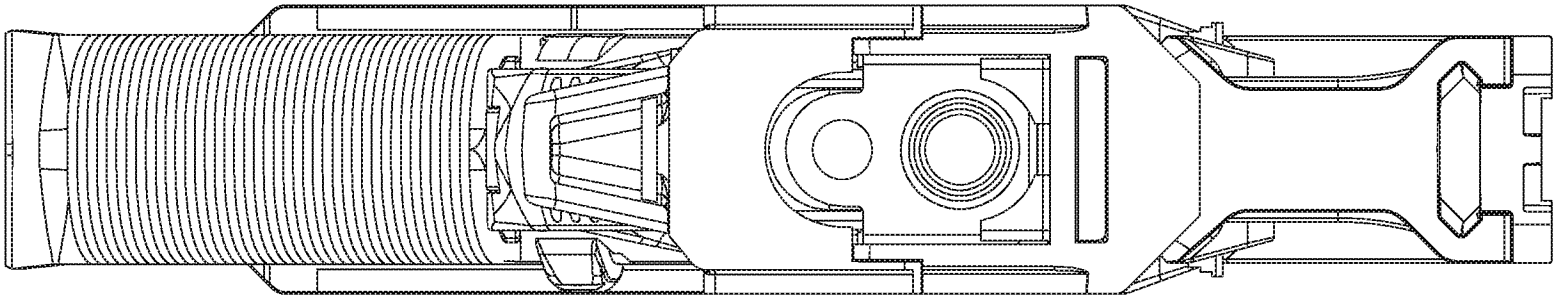
FIG. 8 illustrates a front view of a first embodiment of a foldable firearm in an unfolded configuration.
Figure 9:
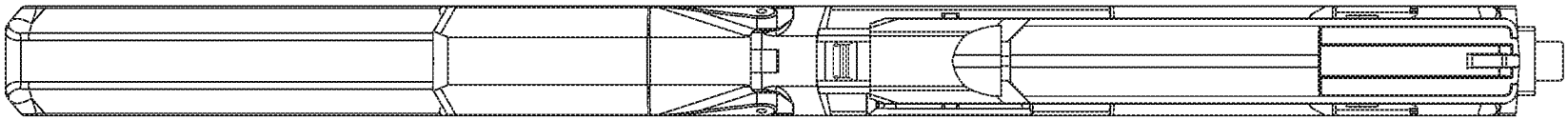
FIG. 9 illustrates a top view of a first embodiment of a foldable firearm in an unfolded configuration.
Figure 10:
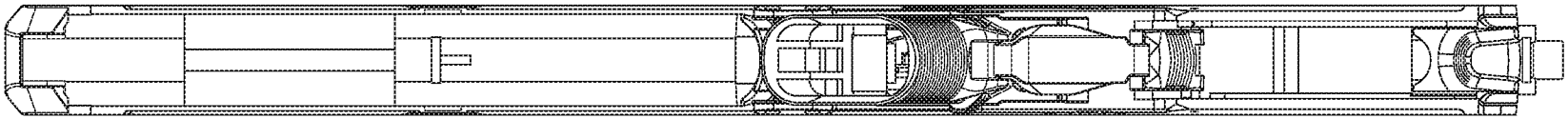
FIG. 10 illustrates a bottom view of a first embodiment of a foldable firearm in an unfolded configuration.

FIG. 5, in addition to FIGS. 31 and 32, illustrates tab 179. Tab 179 may be oriented on the front of ambidextrous charging handle assembly 170. Tab 179 may be of hexagonal geometry, however, in some embodiments, other geometries may be used. Tab 179 may extend horizontally parallel to the longitudinal axis of the firearm 100 and extend from top shell 114. Tab 179 may serve as a latch which may retain hinged tail 102 of bottom shell 116, as illustrated in FIG. 5. Tab 179 may serve to retain foldable firearm 100 in a folded configuration until ambidextrous charging handle assembly 170 is moved rearward about the longitudinal axis of foldable firearm 100 as discussed below. This movement may release bottom shell 116 from the folded configuration. Spring pressure of foldable firearm 100 may then unfold foldable firearm 100.

Figure 39:
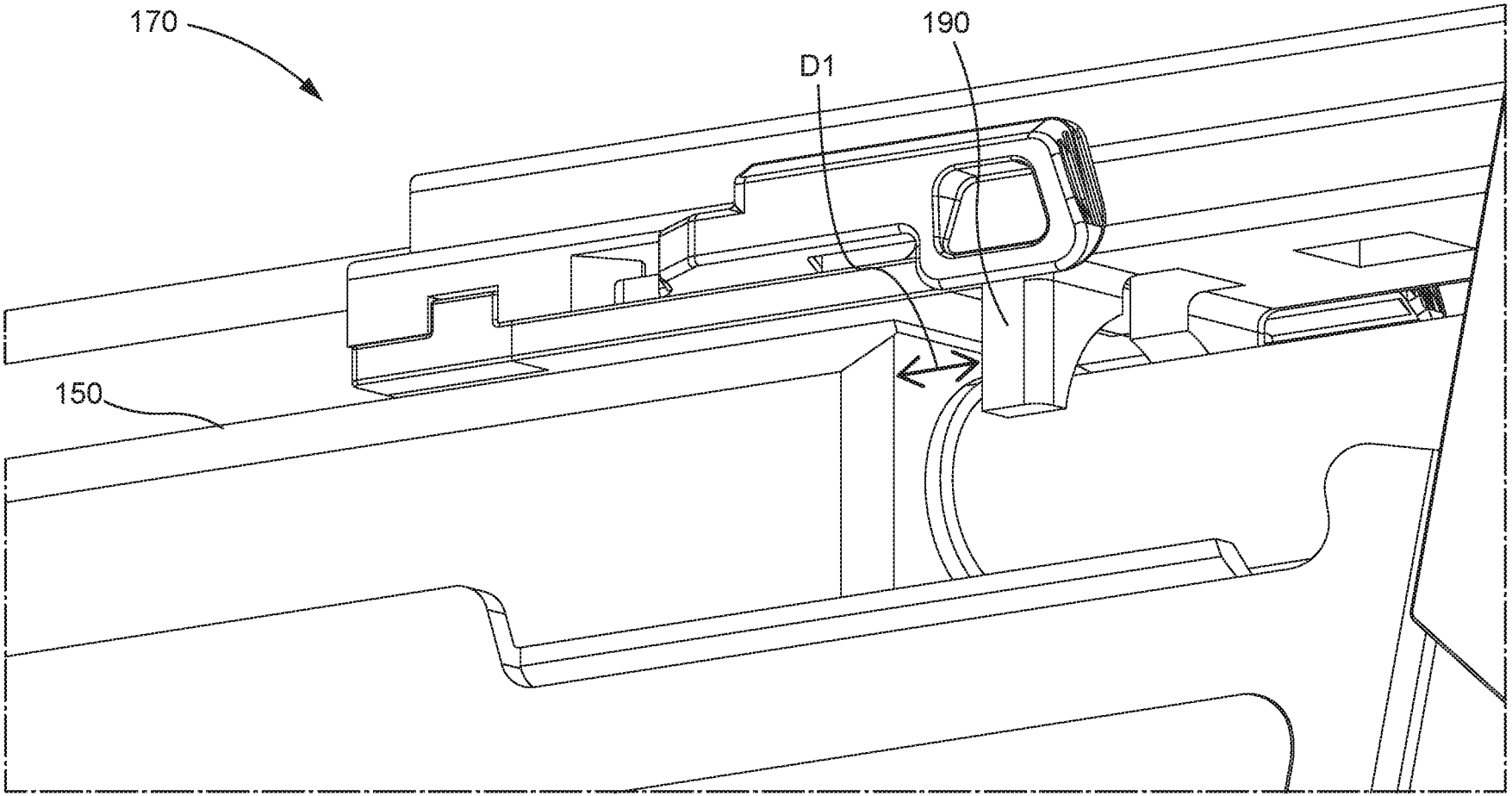
FIG. 39 illustrates a right side close-up view of the detents of the charging handle assembly in relation to the slide of the firearm.

FIG. 39 in addition to FIGS. 31 and 32 illustrate slide racking detents 190 of top portion 176 of ambidextrous charging handle assembly 170. Slide racking detents 190 may be regarded as protrusions that extend from the bottom side of top portion 170 of ambidextrous charging handle assembly 170. Slide racking detents 190 may comprise one protrusion, two protrusions, or other numbers of protrusions in some embodiments. Slide racking detents 190 may be an arched configuration in which the bottom surface of slide racking detents 190 is a hemicylindrical geometry which may be recessed to accept the barrel of foldable firearm 100. Slide racking detents 190 may be fixed to the bottom side of ambidextrous charging handle assembly 170 and arranged in front of the front end of slide 150 by a distance D1. For example, when ambidextrous charging handle assembly 170 is pulled rearward, slide racking detents 190 may impinge on the front of slide 150 and drive slide 150 rearward. Spring pressure from slide 150 may then drive slide 150 and ambidextrous charging handle assembly 170 back forward when ambidextrous charging handle assembly 170 is released. The distance D1 is selected such that pulling first charging handle 172 or second charging handle 174 rearward up to the distance D1 releases bottom shell 116 from tab 179 causing foldable firearm 100 to unfold. Alternatively, pulling either charging handle rearward past the distance D1 to rack slide 150. The charging handles can be butterflied to ease this rearward motion either when unfolding the firearm 100 or when racking the slide 150.

Figure 30:
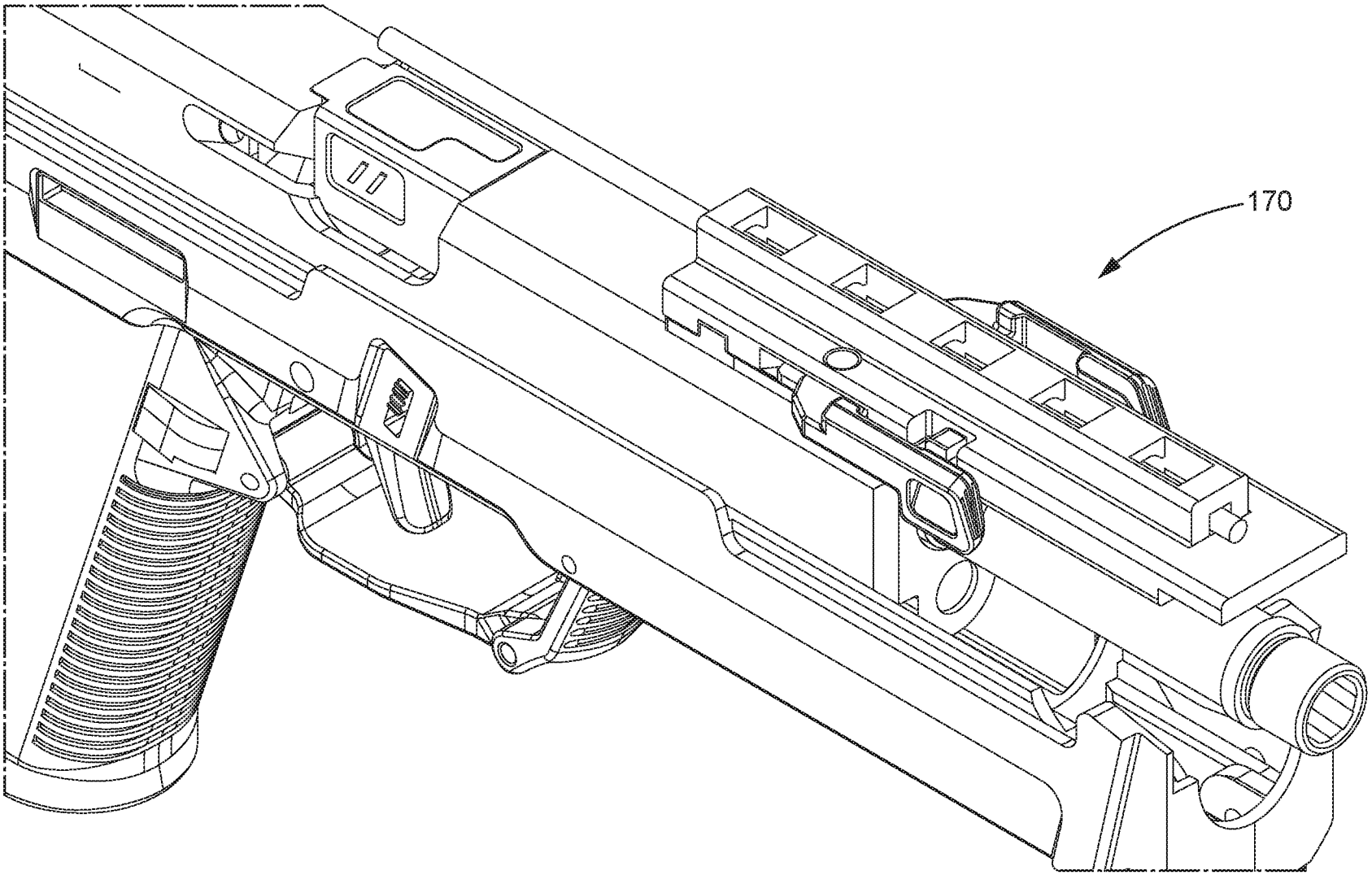
FIG. 30 illustrates a top right view of a charging handle assembly of a foldable firearm.
Figure 40:
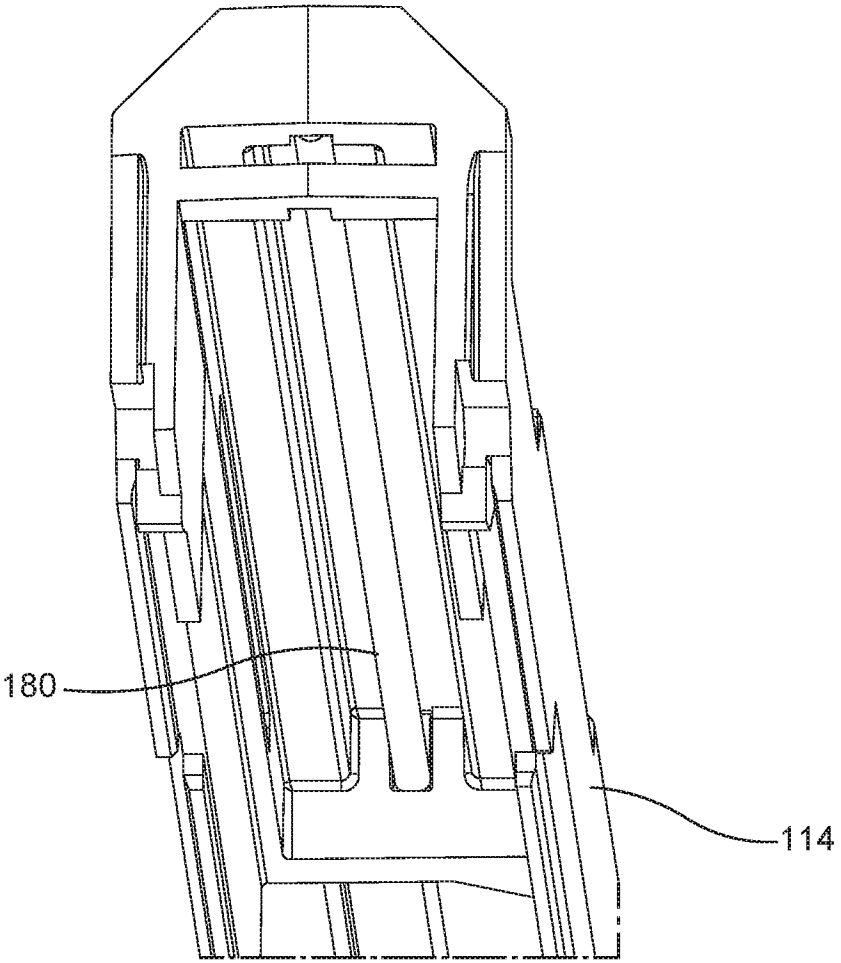
FIG. 40 illustrates a guide rail of the charging handle assembly interfacing with a top shell of a foldable firearm.

In FIGS. 30 and 31, a portion of the top shell 114 of foldable firearm 100 has been hidden. In FIG. 40, all components have been hidden excluding guide rail 180 and top shell 114. FIG. 40 illustrates guide rail 180 interfacing with a hollow section on an inner side of top shell 114. When ambidextrous charging handle assembly 170 is moved (i.e., a user racks slide 150), guide rail 180 may remain fixed to top shell 114 and act as a guide or track for ambidextrous charging handle assembly 170 to slide backward along, and then return along. Ambidextrous charging handle assembly 170 may not be coupled to any portion of the firearm except guide rail 180, however, in some embodiments, it may be coupled to other portions of foldable firearm 100. Although coupling guide rail 180 directly to slide 150 is possible, it may not be preferred in situations where slides from different manufacturers or different models of slide are used since this could require a custom coupling for each model/manufacturer. Also, a direct link to slide 150 may create a reciprocating movement of ambidextrous charging handle assembly 170 which may be hazardous to the user, especially on small firearms such as foldable firearm 100.

Figure 3:
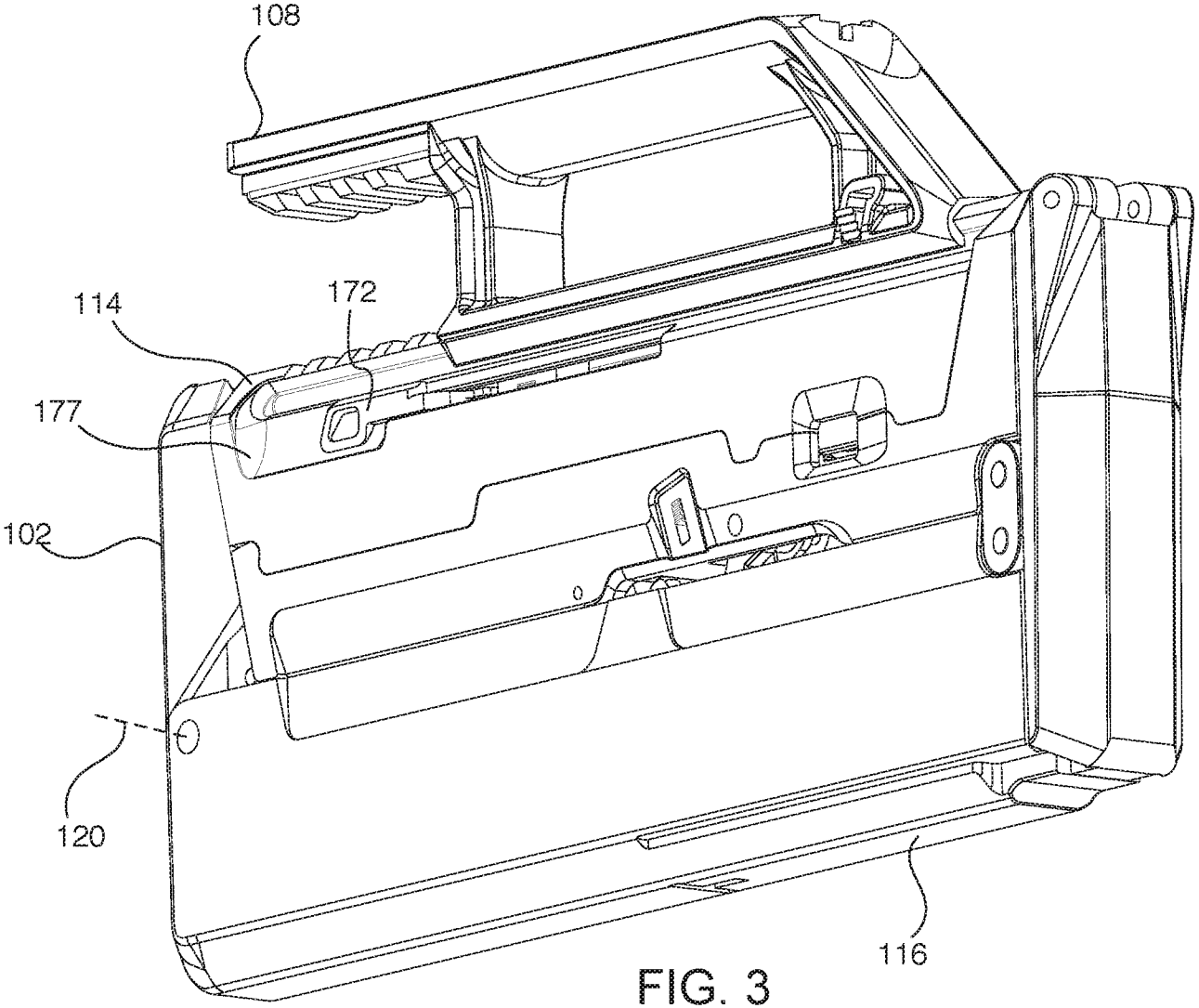
FIG. 3 illustrates a left side view of a first embodiment of a foldable firearm in a folded configuration.

In FIGS. 1 and 3 the foldable firearm 100 can be seen in a folded configuration in which first charging handle 172 and second charging handle 174 are in a folded configuration. First charging handle 172 may rest in a forward-facing orientation flush with the left side of top shell 114 within depression 177, as illustrated in FIG. 3. Second charging handle 174 may rest in a forward-facing orientation flush with the right side of top shell 114 within depression 175 as illustrated in FIG. 1.

With reference to FIGS. 31 and 32 the first charging handle 172 and the second charging handle 174 are shown in relation to top portion 176 and bottom portion 178 of ambidextrous charging handle assembly 170. First charging handle 172 may be oriented such that a cylindrical aperture of first charging handle 172 accepts first pivot nub 161 of bottom portion 178. The cylindrical shape of first pivot nub 161 allows for a first pivot axis about which first charging handle 172 may pivot. As first pivot nub 161 interfaces with first pivot nub aperture 166 of top portion 176, this allows for structural rigidity of the second pivot axis about which first charging handle 172 may rotate. Second charging handle 174 may be oriented such that a cylindrical aperture of second charging handle 174 accepts second pivot nub 162 of bottom portion 178. The cylindrical shape of second pivot nub 162 allows for a second pivot axis about which second charging handle 174 may pivot. As second pivot nub 162 interfaces with second pivot nub aperture 167 of top portion 176, this allows for structural rigidity of the second pivot axis about which second charging handle 172 may rotate.

First charging handle 172 and second charging handle 174 may initiate unfolding of foldable firearm 100. A first embodiment of the unfolding of foldable firearm 100 comprises pulling either first charging handle 172 or second charging handle 174 towards the rear of foldable firearm 100 while the charging handle is in a flush orientation. The pulled charging handle may cause the ambidextrous charging handle assembly 170 to move rearwards at a distance less than D1 (as discussed in relation to, and illustrated in, FIG. 40 above). This may cause tab 179 to lose contact with bottom shell 116 and bottom shell 116 may rotate downward (i.e., deploy) under spring pressure (as discussed in relation to, and illustrated in, FIG. 5 above). In this embodiment, the charging handle is not pivoted, but merely pulled parallel to a longitudinal axis of the firearm 100. Thus, racking of slide 150 is not possible in this configuration as ambidextrous charging handle assembly 170 has not moved distance D1 in order for the slide racking detents 190 to contact the front part of slide 150. Thus, a user can deploy the firearm 100 without racking the slide 150.

A second embodiment of unfolding foldable firearm 100 comprises pivoting either first charging handle 172 or second charging handle 174 about its pivot axis, "butterflying" the charging handle outwards. The initiating charging handle can pivot a certain degree before engaging with the opposing charging handle and starting to cause that charging handle to also butterfly. Alternatively, the charging handles can interface such that butterflying of one charging handle immediately causes butterflying of the opposing charging handle. When either charging handle is moved rearward (either in a butterflied or flush orientation to the top shell 114) more than D1, the slide racking detents 190 contact the front of slide 150. Pivoting either charging handle such that the large detent of the pivoted charging handle contacts the opposing charging handle's small detent may cause the opposing charging handle to pivot about its pivot axis, thus butterflying the opposing charging handle (discussed further in relation to FIGS. 33-38 below).

First charging handle 172 or second charging handle 174 may also rack slide 150 of foldable firearm 100. For example, if either first charging handle 172 or second charging handle 174 is pivoted to a ninety-degree angle from a flush configuration and pulled rearwards to or greater than a distance of D1, the slide racking detents 190 will make contact with the front of slide 150 and begin pulling the slide 150 backwards. Continuing to pull rearwards on the pivoted charging handle may begin to rack slide 150. Once racking is complete, spring pressure of slide 150 of foldable firearm 100 may then force both slide 150 and ambidextrous charging handle assembly 170 forward to charge foldable firearm 100.

FIGS. 33, 34, 35, 36, 37, and 38 illustrate embodiments of first charging handle 172 and second charging handle 174 during butterflying of the charging handles. First charging handle 172 may comprise first large detent 182, first small detent 184, and first recess 192. Second charging handle 174 may comprise second large detent 188, second small detent 186, and second recess 194. First large detent 182, second small detent 186, and second recess 194 may be arranged on an upper level. However, in some embodiments, first large detent 182, second small detent 186, and second recess 194 may be oriented on a different level. Second large detent 188, first small detent 184, and first recess 192 may be arranged on a lower level. However, in some embodiments, second large detent 188, first small detent 184, and first recess 192 may be arranged on a different level. First charging handle 172 may pivot about the first pivot axis as discussed in relation to FIGS. 32 and 33 above. Second charging handle 174 may pivot about the second pivot axis as discussed in relation to FIGS. 32 and 33 above.

Figure 33:
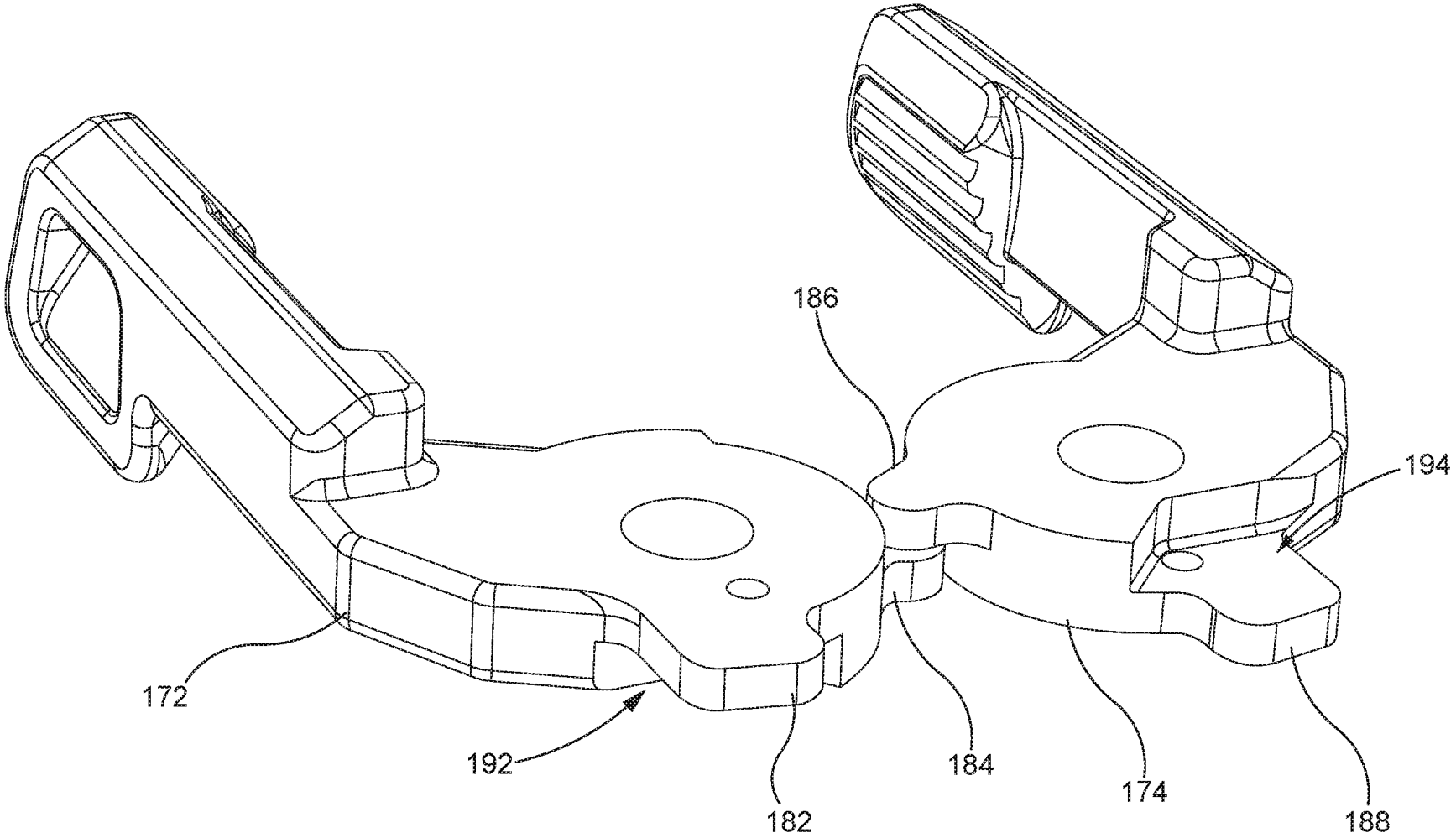
FIG. 33 illustrates a close-up view of the charging handles of a charging handle assembly in a forward-facing position.

FIG. 33 illustrates the charging handles in a forward-facing orientation. The forward-facing orientation may be regarded as the flush orientation as discussed previously. In this orientation first charging handle 172 may rest flush with top shell 114 in depression 175 as illustrated in FIG. 1. Second charging handle 174 may rest flush with top shell 114 in depression 177 as illustrated in FIG. 3. In the forward-facing orientation, first large detent 182 may not interface with second small detent 186 or second depression 194 on the upper level. In this orientation, second large detent 188 may not interface with first small detent 184 or first recession 192 on a lower level. In this orientation, pulling rearwards on either first charging handle 172 or second charging handle 174 with or without butterflying the charging handles can trigger unfolding of the firearm 100. In this orientation, butterflying of the charging handles may occur by pivoting the first charging handle about the first pivot axis, as illustrated and discussed in relation to FIGS. 34, 35, and 36 below. Alternatively, butterflying of the charging handles may occur by pivoting the second charging handle about the second pivot axis, as illustrated and discussed in relation to FIGS. 37 and 38 below.

Figure 34:
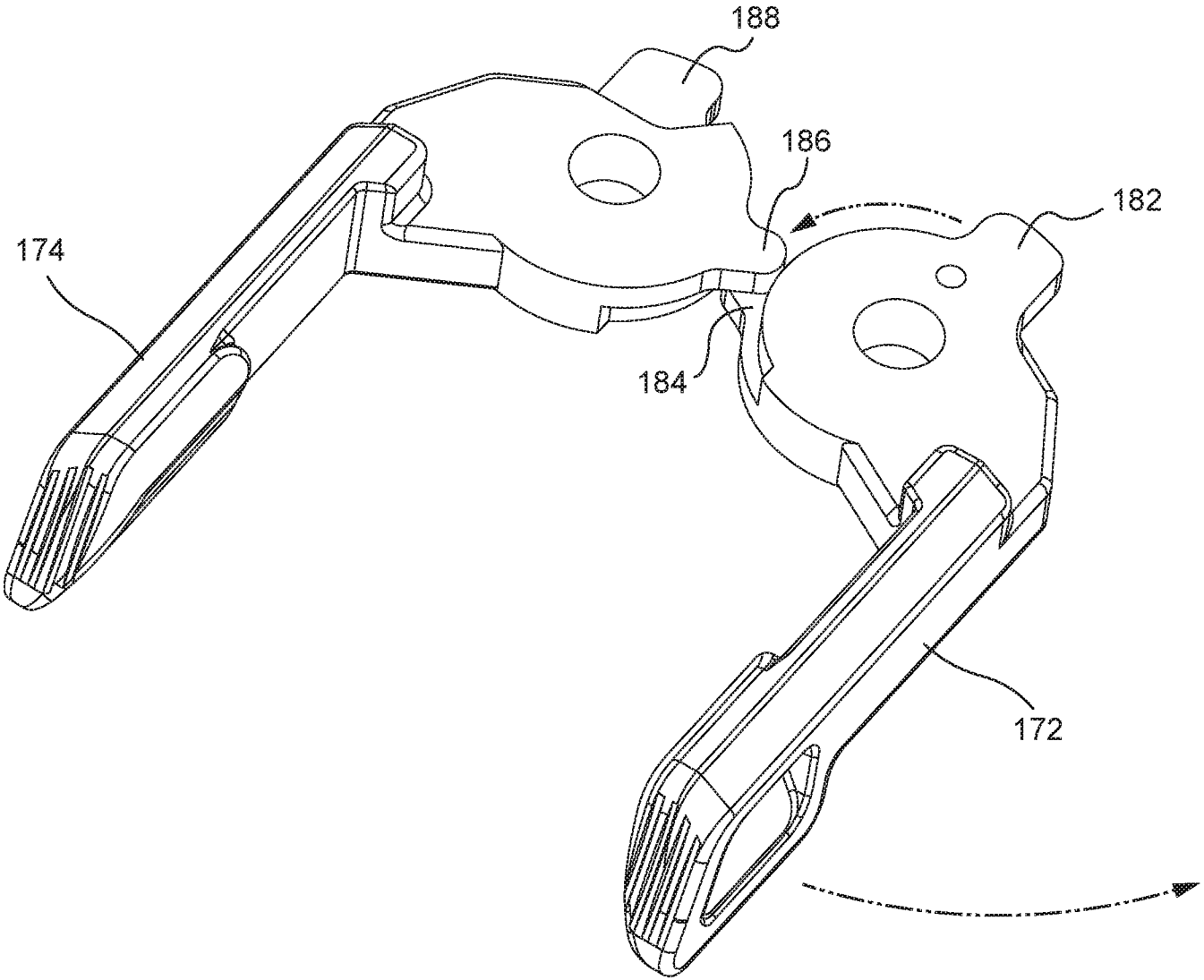
FIG. 34 illustrates a close-up view of the charging handles of a charging handle assembly undergoing an initial rotation of the first charging handle.

FIG. 34 illustrates another view of the flush position of the charging handles. Arrows indicate initial pivoting or butterflying that the charging handles can undergo. During initial rearward rotation, first charging handle 172 may rotate about the first pivot axis rearwards and may approach the rotational degree of the interface of first large detent 182 with first small detent 186. In this orientation, second charging handle 174 may not pivot rearward about the second pivot axis.

Figure 35:
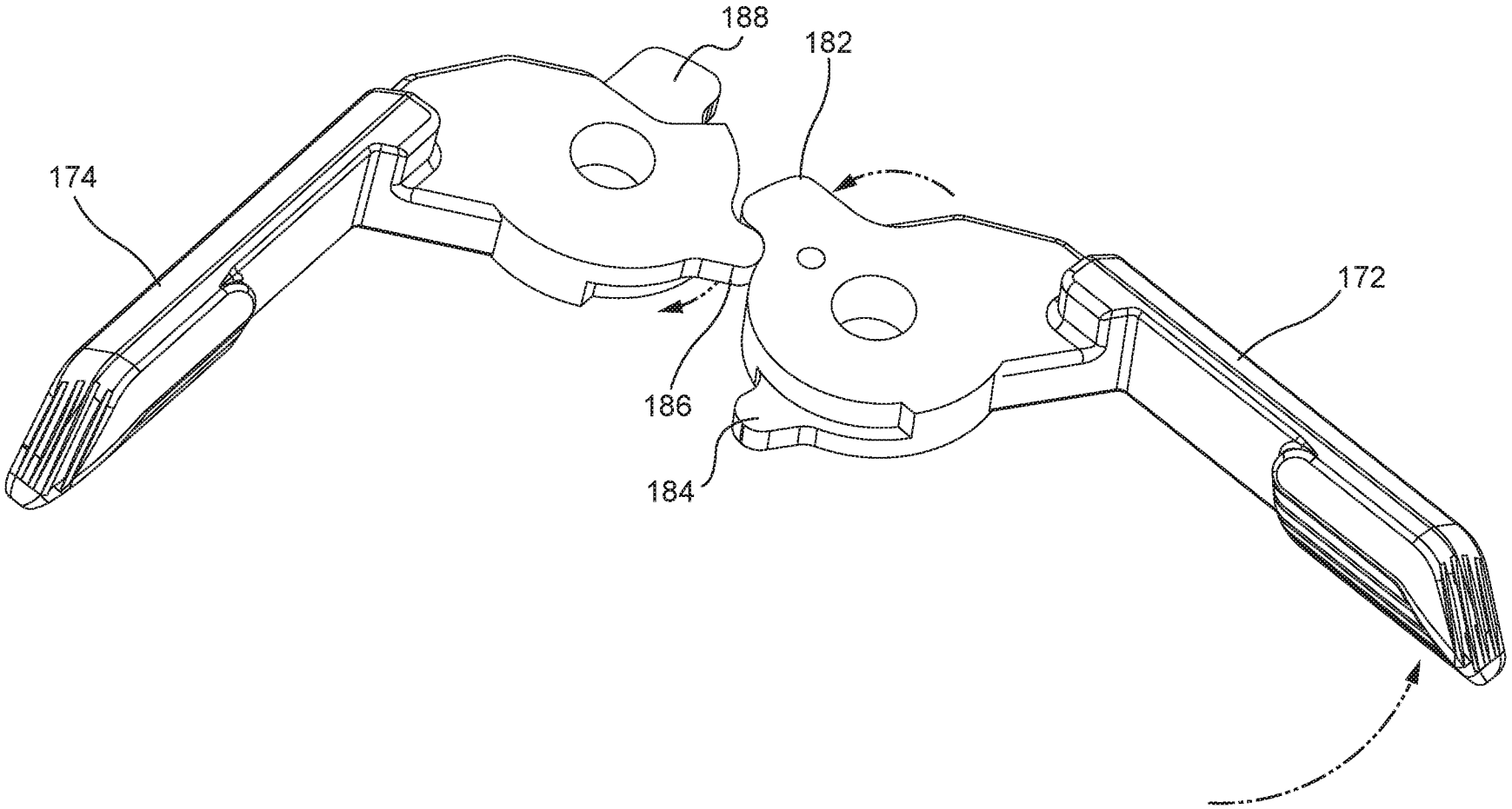
FIG. 35 illustrates a close-up view of the charging handles of a charging handle assembly undergoing rotation of the first charging handle wherein the detents of the charging handles make initial contact.

FIG. 35 illustrates the charging handles at the point in rotation or butterflying where the detents of the charging handles make initial contact. In this orientation, first charging handle 172 may pivot about the first pivot axis rearwards until the first large detent 182 interfaces with the second small detent 186 on the upper level. Continued rotation of first charging handle 172 rearwards may cause for second charging handle 174 to begin to rotate rearwards about the second pivot axis to a degree less than that of first charging handle 172 (as illustrated in, and discussed in relation to, FIG. 36 below).

Figure 36:
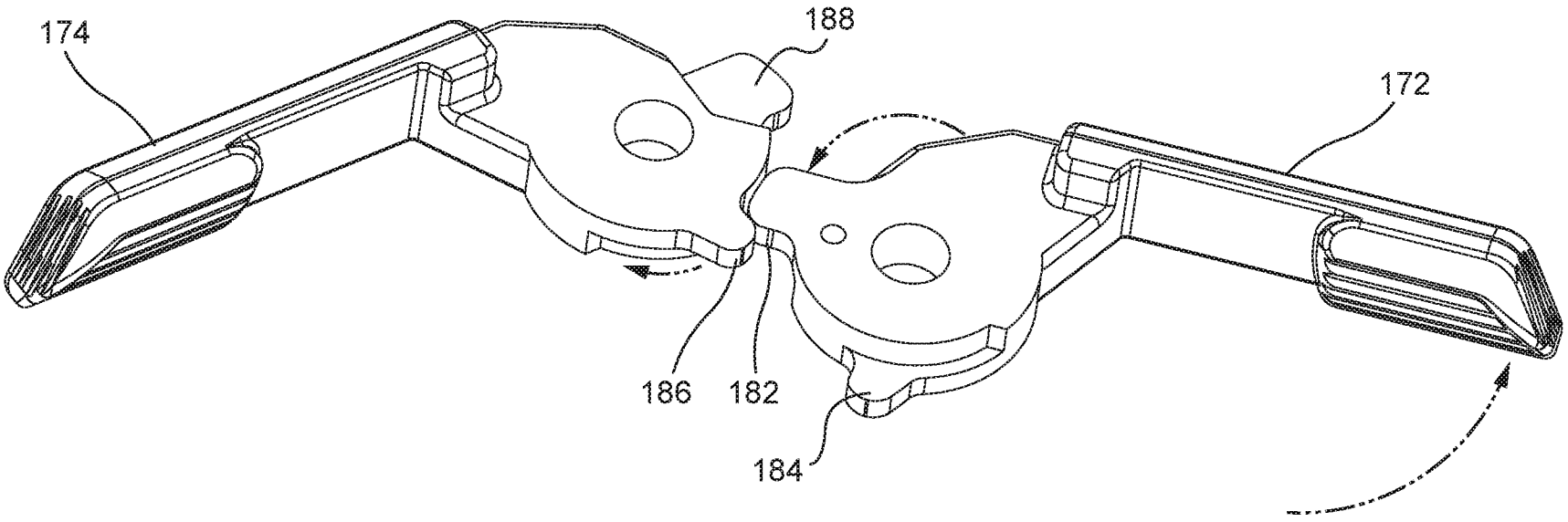
FIG. 36 illustrates a close-up view of the charging handles of a charging handle assembly in a final butterflied position after undergoing rotation of the first charging handle.

FIG. 36 illustrates the charging handles of ambidextrous charging handle assembly 170 in a final butterflied position after undergoing rotation of first charging handle 172. The rotation of first charging handle 172 rearwards may have caused second charging handle 174 to rotate rearwards about the second pivot axis to a degree less than that of first charging handle 172. First charging handle 172 may be oriented in a substantially perpendicular orientation about the longitudinal axis of foldable firearm 100, which may be regarded as a ninety-degree rotation. Second charging handle 174 may be oriented in a less than perpendicular orientation about the longitudinal axis of foldable firearm 100. In this orientation, first charging handle 172 may be pulled rearwards parallel to the longitudinal axis of foldable firearm 100 to rack slide 150 of foldable firearm 100 as discussed previously.

Figure 37:
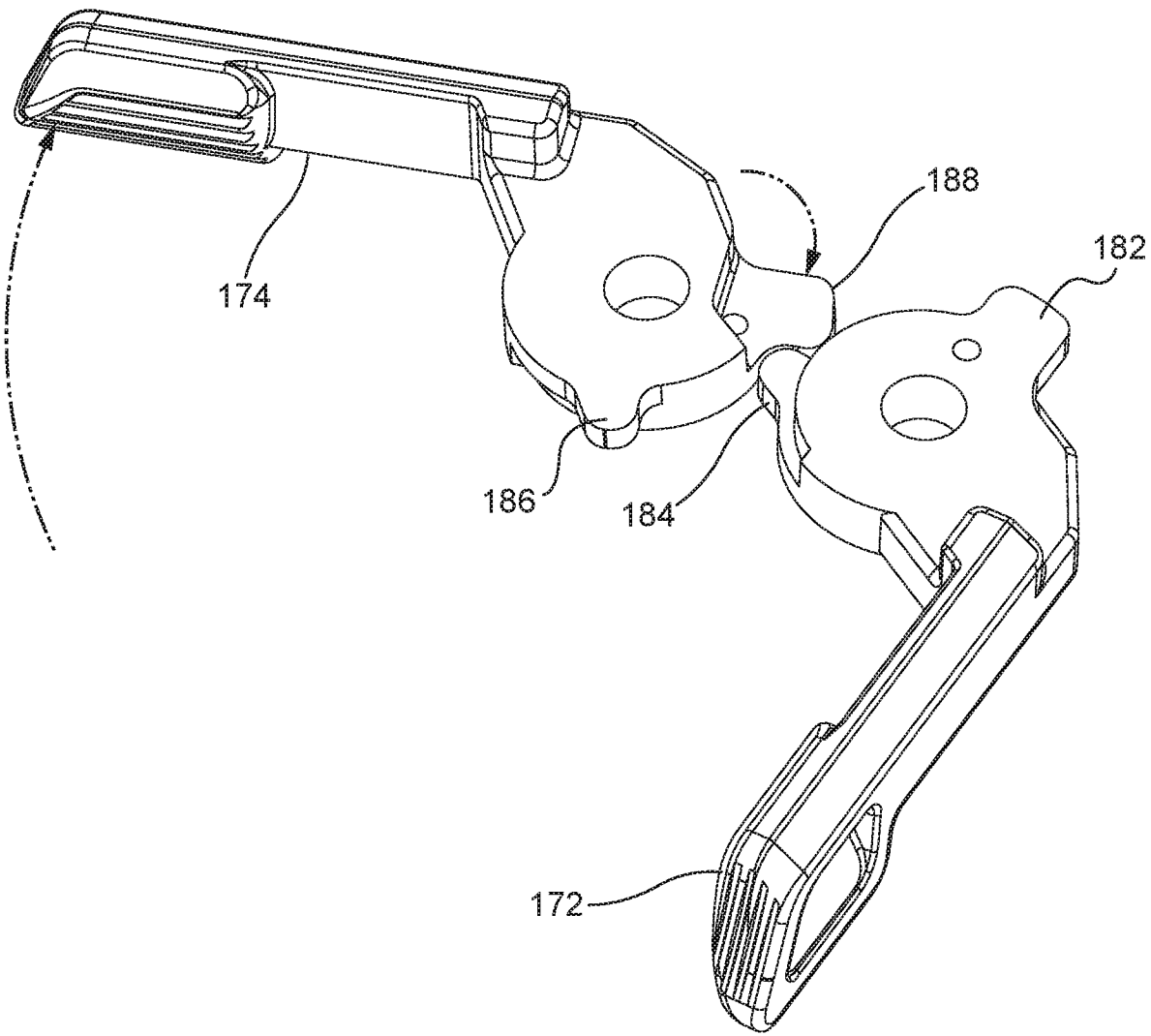
FIG. 37 illustrates a close-up view of the charging handles of a charging handle assembly undergoing rotation of the second charging handle wherein the detents of the charging handles make initial contact.

FIG. 37 illustrates the charging handles of ambidextrous charging handle assembly 170 undergoing rotation of second charging handle 174 rearward at the orientation where the detents of the charging handles make initial contact. In this orientation, second charging handle 174 may pivot about the second pivot axis rearwards until the second large detent 188 interfaces with the first small detent 184 on the lower level. Continued rotation of second charging handle 174 rearwards may cause the first charging handle 172 to begin to rotate rearwards about the first pivot axis to a degree less than that of second charging handle 174 (as illustrated in, and discussed in relation to, FIG. 38 below).

Figure 38:
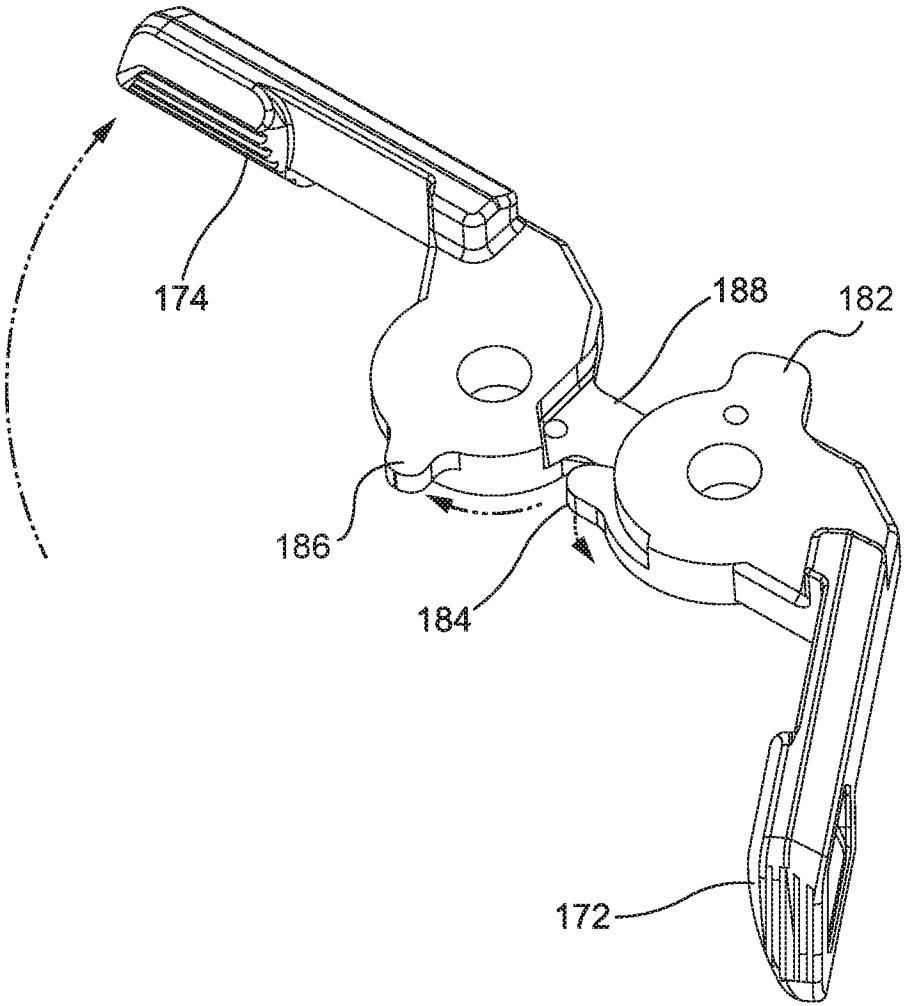
FIG. 38 illustrates a close-up view of the charging handles of a charging handle assembly in a final butterflied position after undergoing rotation of the second charging handle.

FIG. 38 illustrates the charging handles of ambidextrous charging handle assembly 170 at a position further butterflied than is shown in FIG. 37. In this orientation, second charging handle 174 may have pivoted about the second pivot axis rearwards whereas the second large detent 188 interfaced with the first small detent 184 on the lower level. The rotation of second charging handle 174 rearwards may have caused first charging handle 172 to rotate rearwards about the first pivot axis to a degree less than that of second charging handle 174. Second charging handle 174 may be oriented in a substantially perpendicular orientation to the longitudinal axis of foldable firearm 100, which may be regarded as a roughly ninety-degree rotation. First charging handle 172 may be oriented in a less than perpendicular orientation about the longitudinal axis of foldable firearm 100. In this orientation, second charging handle 174 may be pulled rearward parallel to the longitudinal axis of foldable firearm 100 to rack slide 150 of foldable firearm 100 as discussed previously.

Tail/Arm Design

The herein disclosed foldable firearm can fold into a box-like shape. The folding firearm can include a hinged tail that is inoperable as a butt stock, but can be used as an arm brace and can hide and protect the muzzle when the folding firearm is in the stowed state. In particular, the tail of a folding firearm typically is fixed to the rear end of the firearm and forms an elongated fixed surface that can be pressed against the area between the user's chest and shoulder in order to provide stability, accuracy and mitigate the effects of recoil. The larger this elongated surface, the more that the kickback can be distributed, and hence the more comfortable the firearm is to fire and the easier it is to control. As this elongated surface shrinks, the concentration of pressure on the user increases and eventually the surface area can become so small as to render the firearm difficult to use. The herein disclosed tail is hinged, thereby decreasing the fixed surface area to the point that it is no longer viable to use as a shoulder stock. In other words, as the user presses the firearm against the shoulder pocket, the hinged tail gives way to such pressure, and folds. As a result, the hinged tail does not aid in distributing recoil forces or in offering a useful surface for shoulder support since it is by its very nature unstable. While those of skill in the art would seek to increase the surface area of the tail, this disclosure unexpectedly seeks to shrink the usable surface area of the tail.

However, the hinged tail does provide lateral stability for use as an arm brace. While some folding firearms have previously been used with buttstocks, some firearms can also be fired like a pistol, with both arms extended or nearly extended, and the firearm extended away from and not touching any portion of the user's torso. To provide support for this type of firing, armbraces have been used to stabilize firing. Armbraces can include straps and/or rigid structures. Thus, herein disclosed hinged tail is so small as to be inoperable as a buttstock, but allowing this structure to act as an armbrace for firing with both arms extended or nearly extended.

In use, the hinged tail can be in a hinged state. When the foldable firearm is folded or stowed (e.g., see FIG. 3), the hinged tail is in a rest position under spring pressure, and surrounds and covers a front of the foldable firearm to both hide and protect the muzzle.

FIG. 1 illustrates a first embodiment of a foldable firearm with a first hinged tail. The foldable firearm 100 includes a hinged tail 102, a foldable pistol grip 104, a hand stop 106, a carrying handle 108, a muzzle 110, a foldable trigger grip assembly 112, a top shell 114, and a bottom shell 116. The hinged tail 102 can include an angled clearance 118 shaped to allow the hinged tail 102 to hinge or rotate about pivot axis 120. The angle of the angled clearance 118 can be selected to determine a stopping angle of the hinged tail 102. As the hinged tail 102 rotates about the pivot axis 120, eventually the angle between the angled clearance 118 and the underside of the bottom shell 116 becomes 0°, meaning the two components meet, and the hinged tail 102 cannot rotate further.

Figure 11:
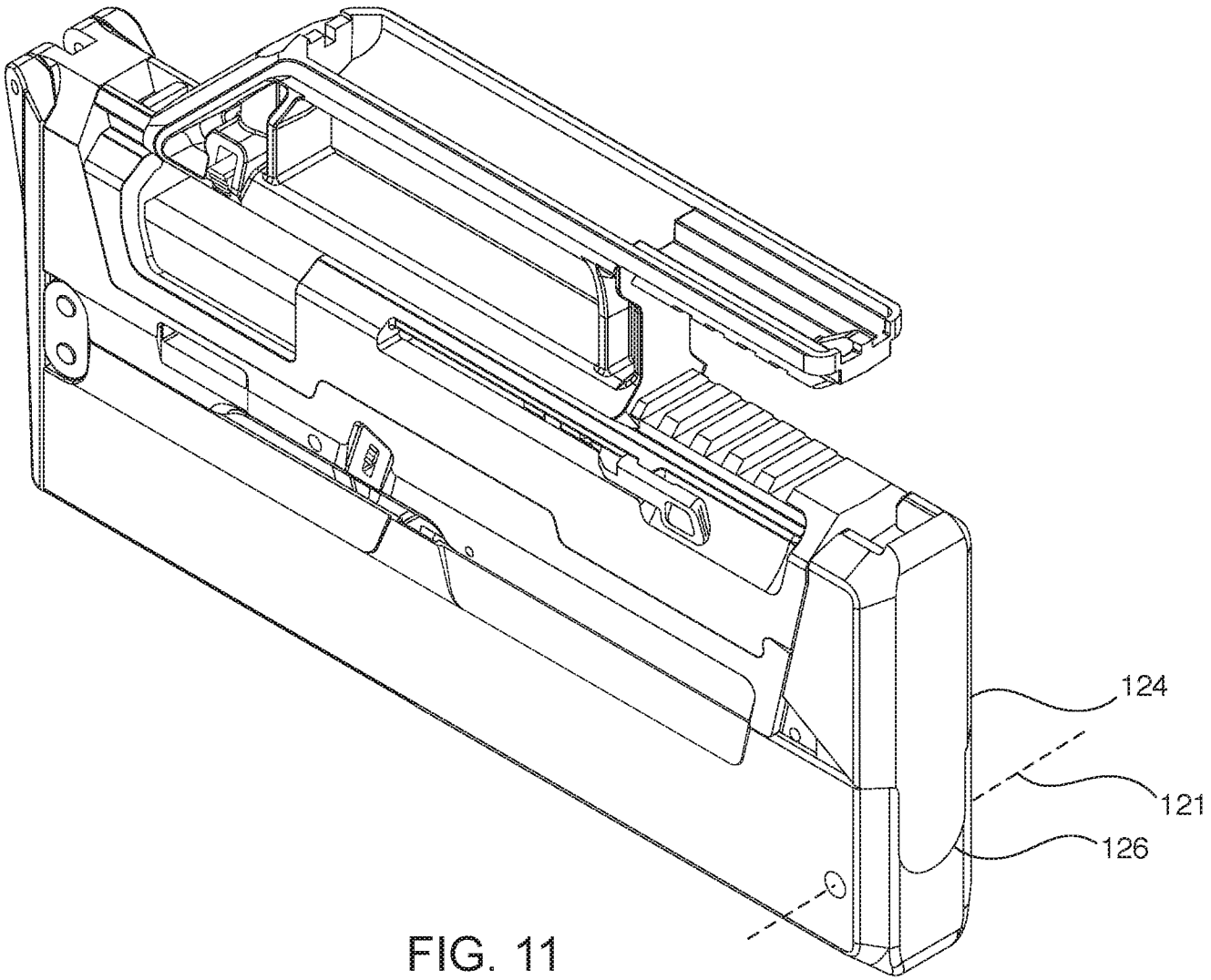
FIG. 11 illustrates a right-side view of a second embodiment of a foldable firearm in a folded configuration.

FIG. 11 illustrates a second embodiment of a foldable firearm with a second hinged tail, in a folded state. The second hinged tail 124 is taller/longer than the first hinged tail 102 and includes an arced top 126. A pivot axis 121 is adjusted vertically to account for the longer hinged tail 124.

Figure 12:
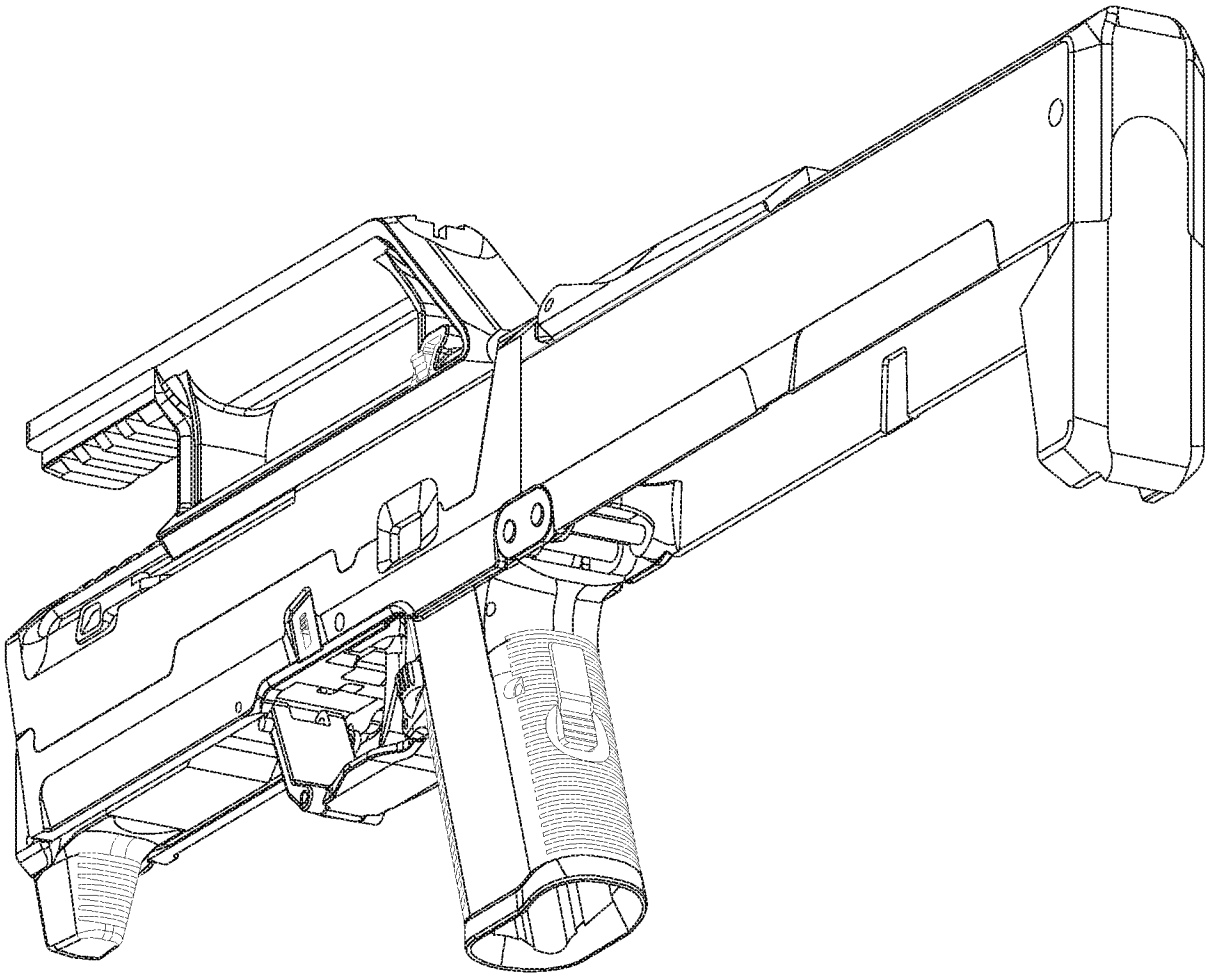
FIG. 12 illustrates a left side view of a second embodiment of a foldable firearm in an unfolded configuration.

FIG. 12 illustrates a deployed view of the foldable firearm of FIG. 11.

Figure 13:
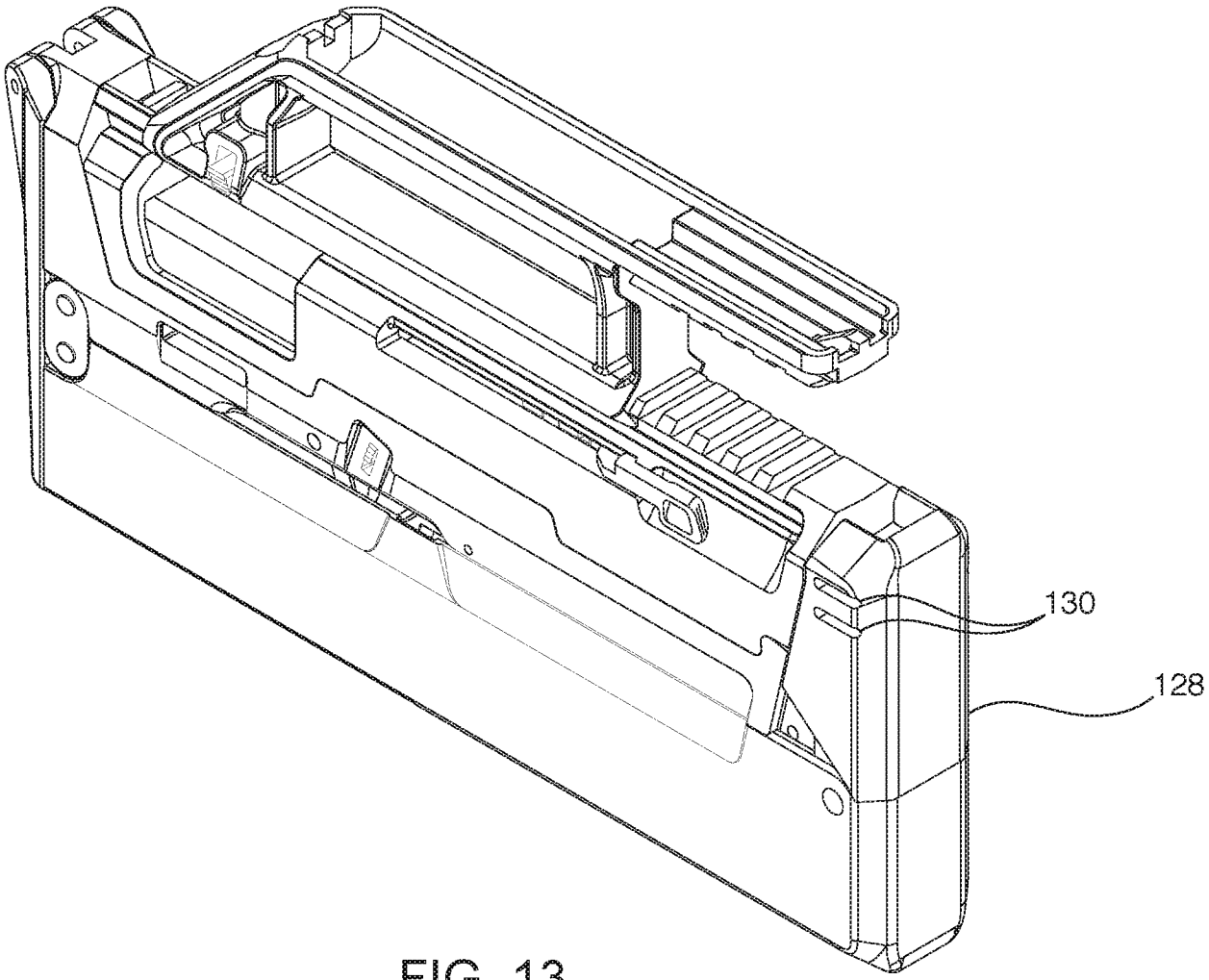
FIG. 13 illustrates a right-side view of a third embodiment of a foldable firearm in a folded configuration.

FIG. 13 illustrates a third embodiment of a foldable firearm with a third hinged tail, the hinged tail inclusive of a bracing strap or apertures to affix a bracing strap. The foldable firearm is here illustrated in a folded state. The third hinged tail 128 has the same shape as the first hinged tail 102, but adds apertures 130 or other attachment points for a bracing strap (e.g., see FIG. 29). The bracing strap can be wrapped around an arm, shoulder, or torso of a user, to enhance shooting accuracy and reduce the effects of kick-back when the foldable firearm is fired.

Figure 14:
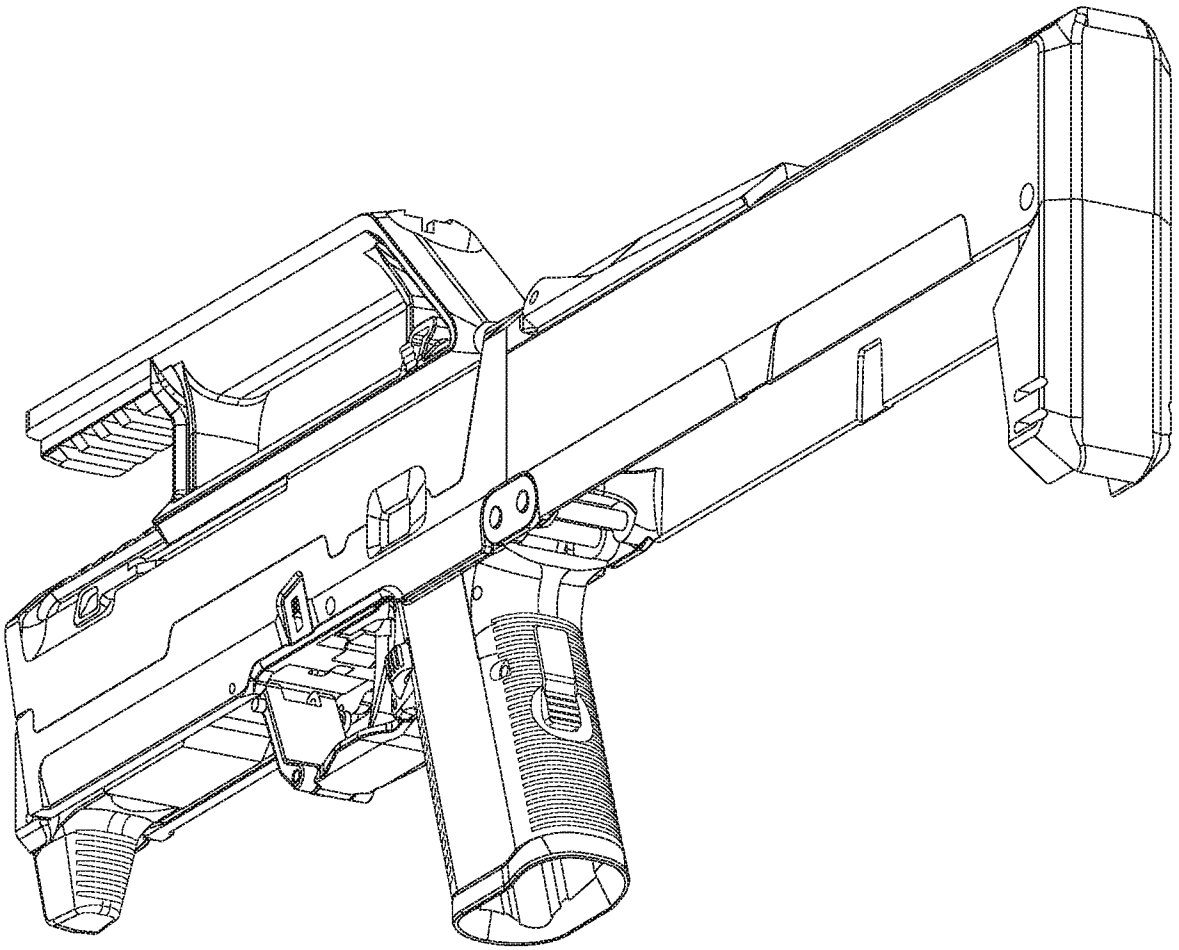
FIG. 14 illustrates a left side view of a third embodiment of a foldable firearm in an unfolded configuration.

FIG. 14 illustrates a deployed view of the foldable firearm of FIG. 13.

Figure 15:
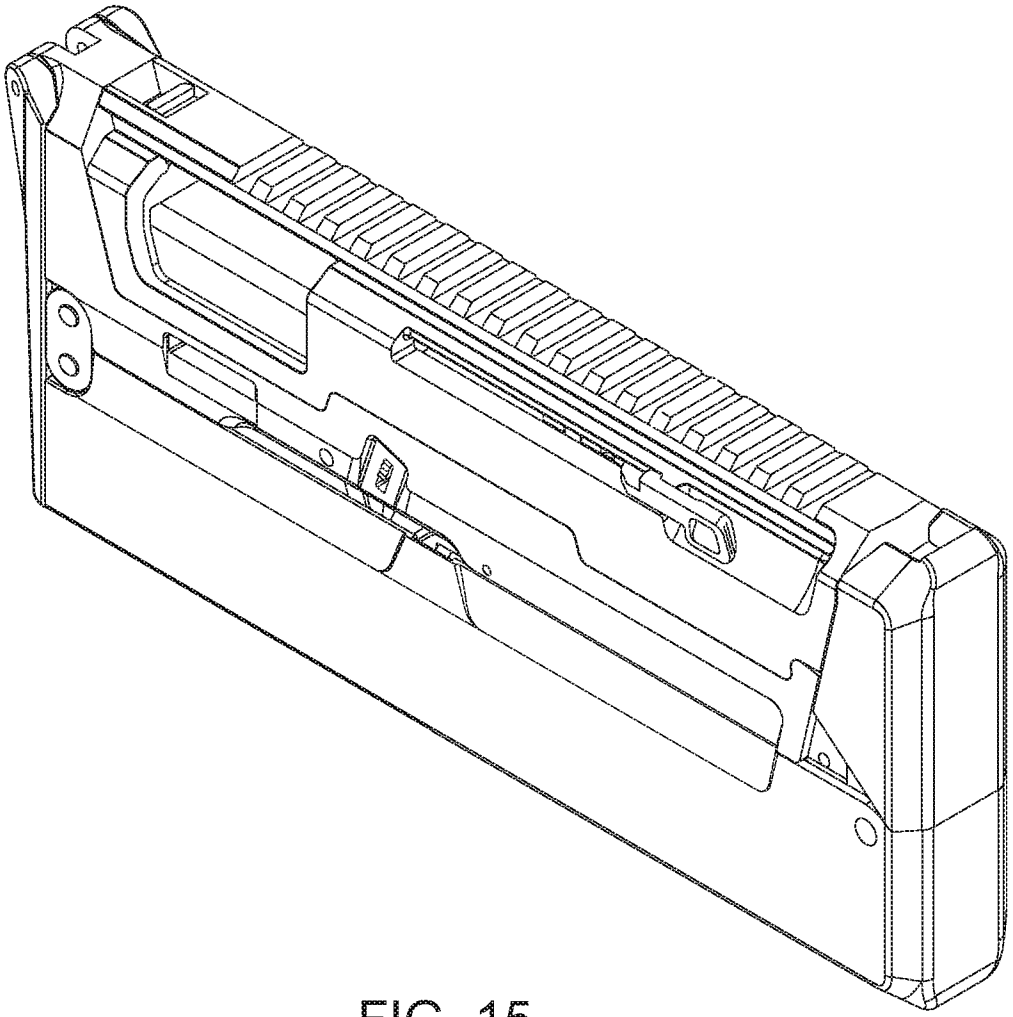
FIG. 15 illustrates a right-side view of a fourth embodiment of a foldable firearm in a folded configuration.
Figure 16:
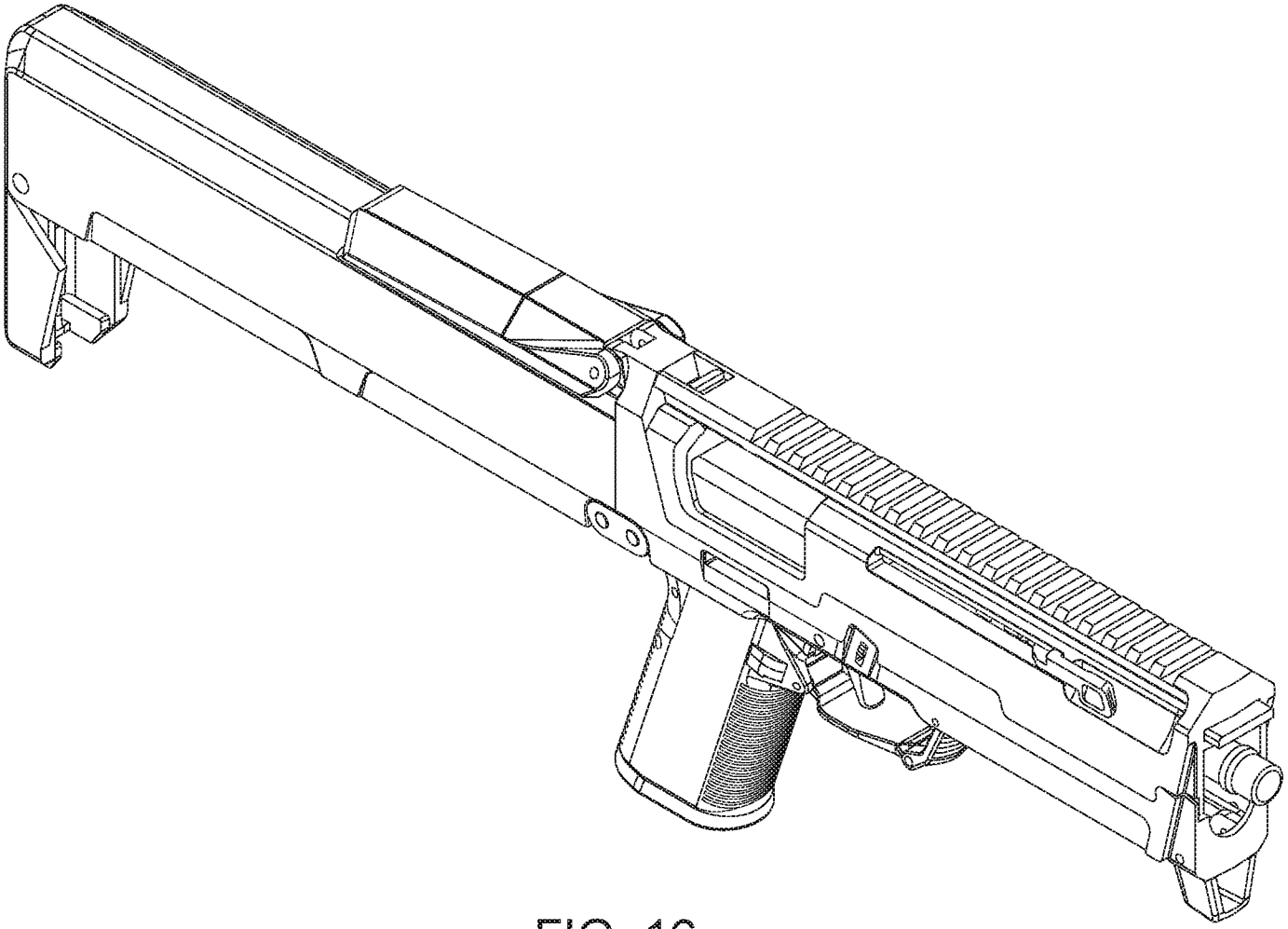
FIG. 16 illustrates a right-side view of a fourth embodiment of a foldable firearm in an unfolded configuration.
Figure 17:
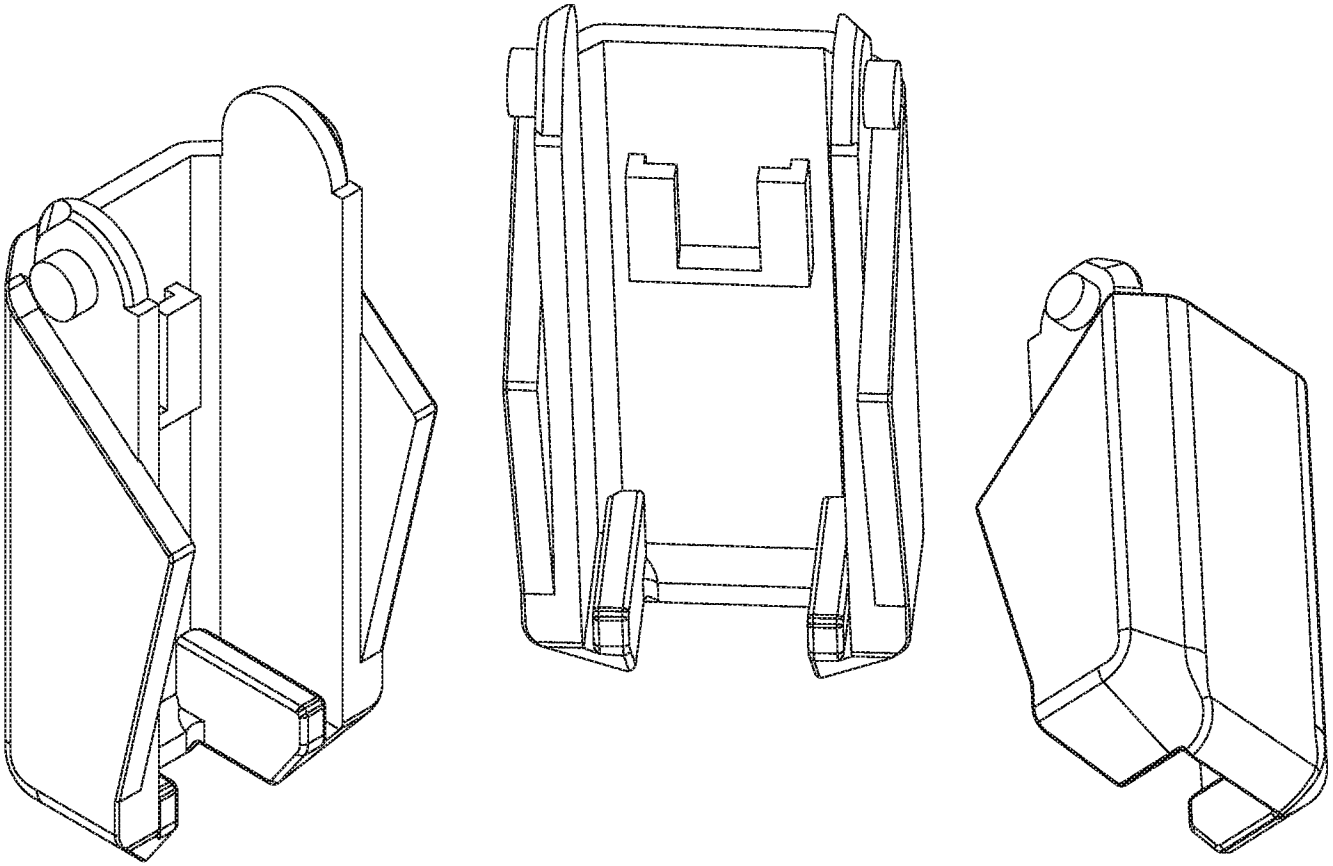
FIG. 17 illustrates isolated views of a first tail of the first embodiment of a foldable firearm.
Figure 18:
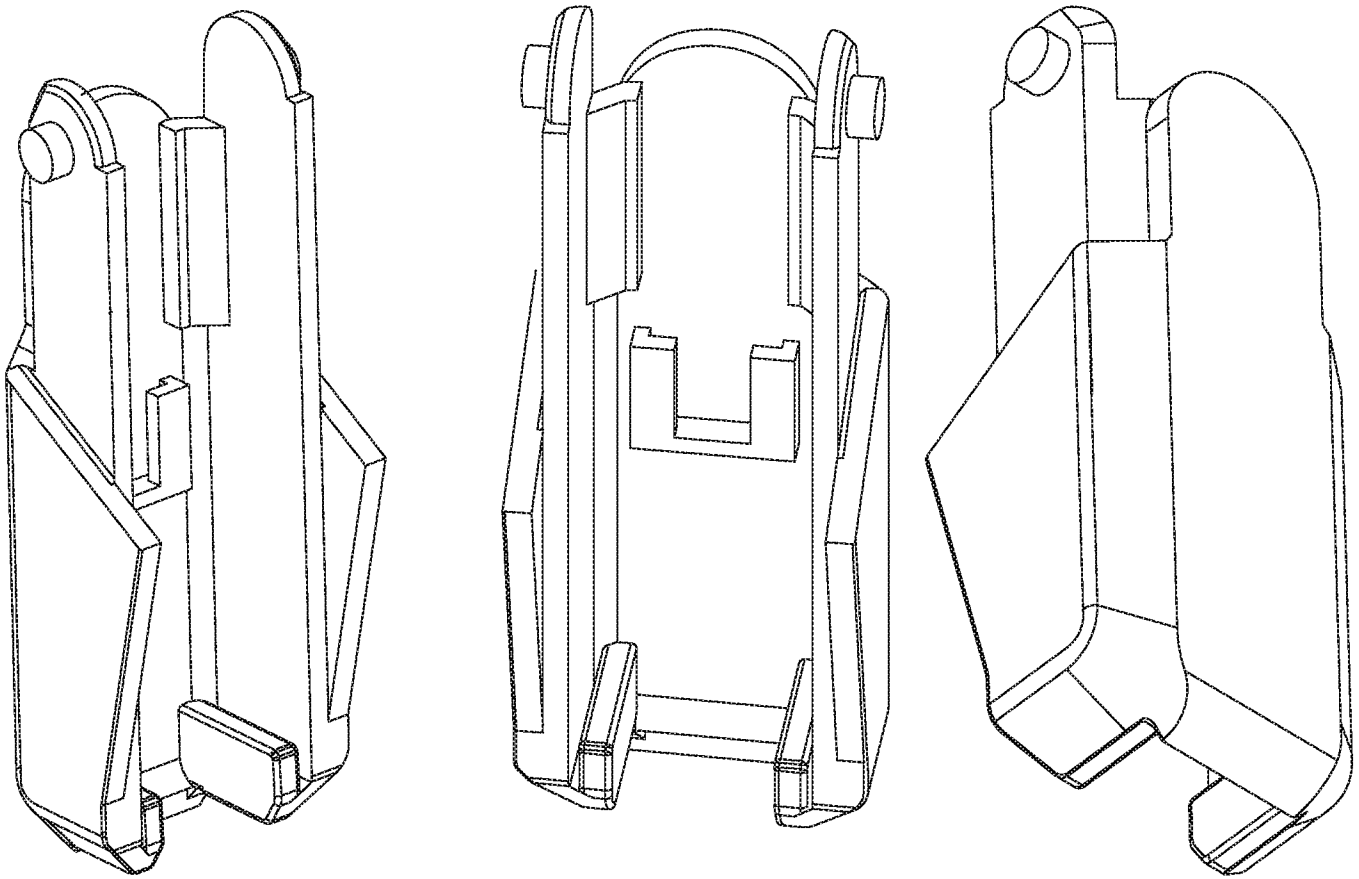
FIG. 18 illustrates isolated views of a second tail of the second embodiment of a foldable firearm.
Figure 19:
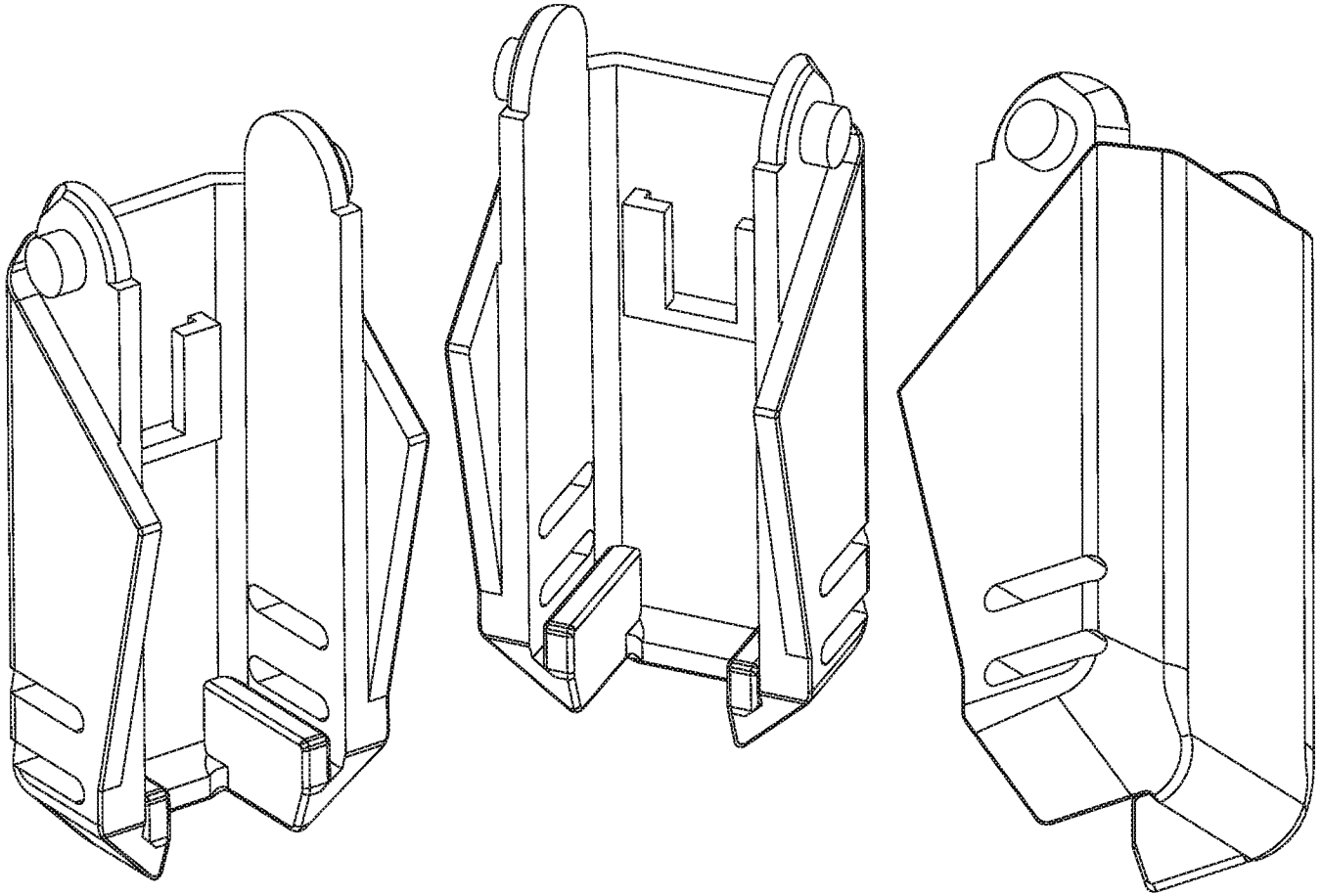
FIG. 19 illustrates isolated views of a third tail of the third embodiment of a foldable firearm.
Figure 20:
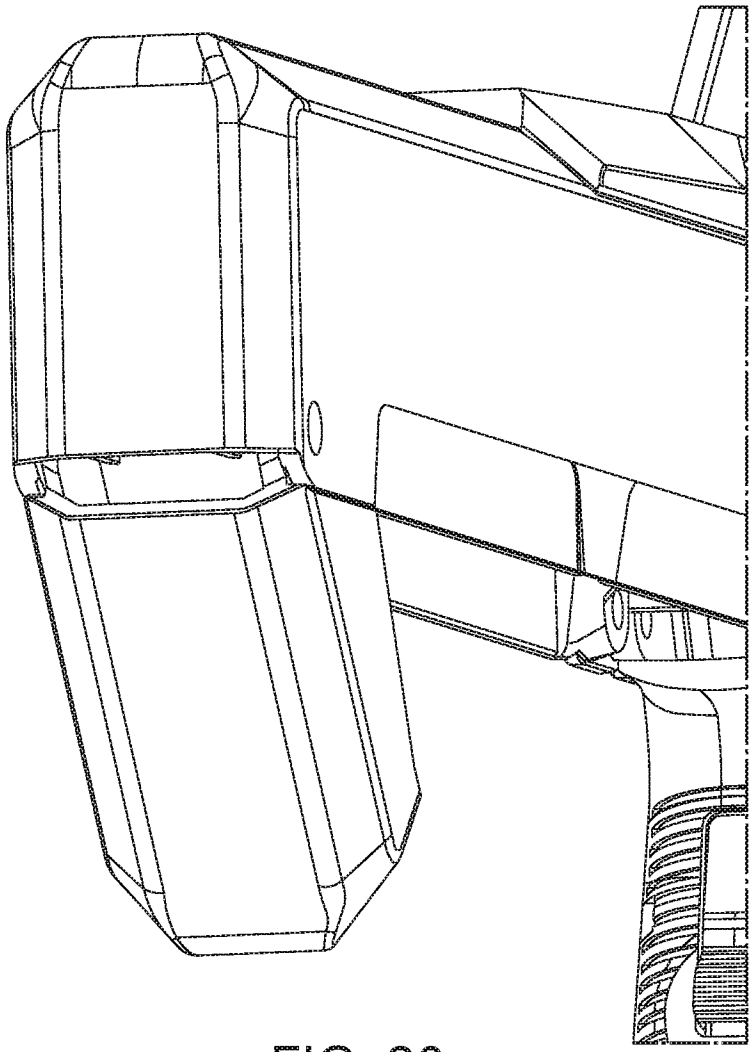
FIG. 20 illustrates a close-up outside view of a first tail of the first embodiment of a foldable firearm in a hinged state.
Figure 21:
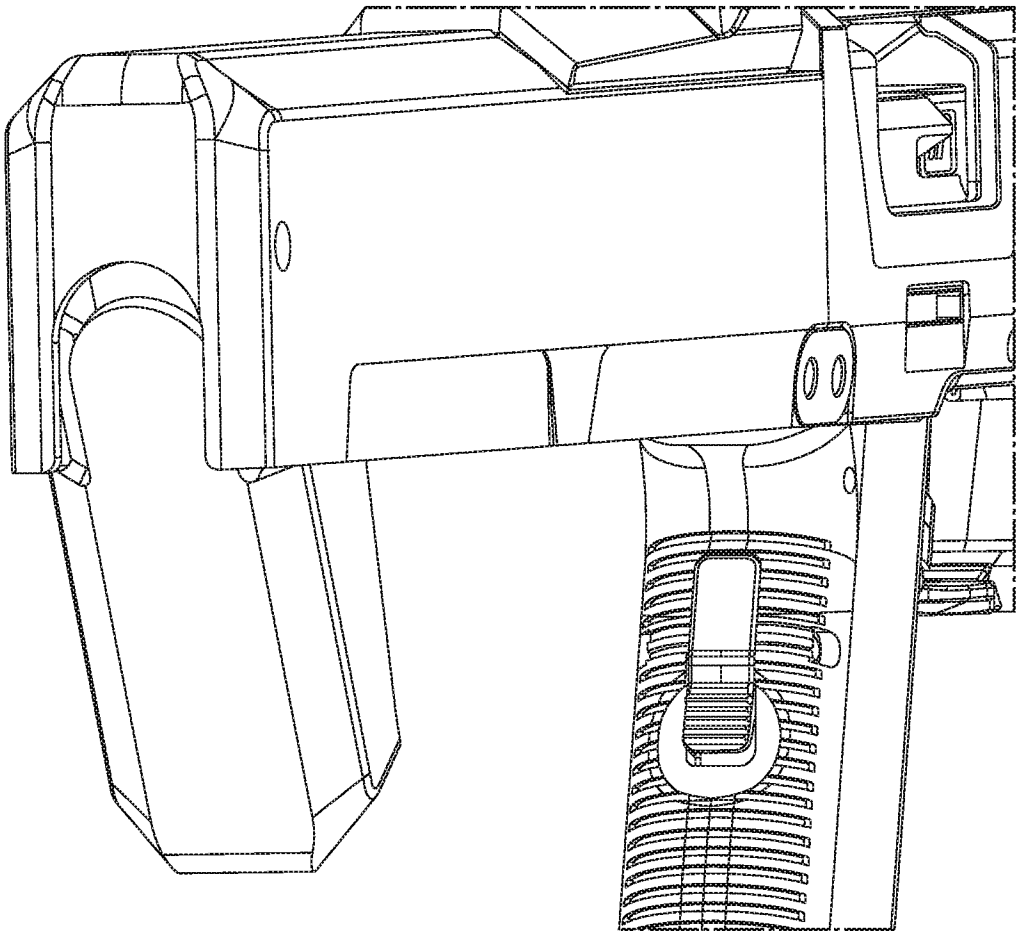
FIG. 21 illustrates a close-up outside view of a second tail of the second embodiment of a foldable firearm in a hinged state.
Figure 22:
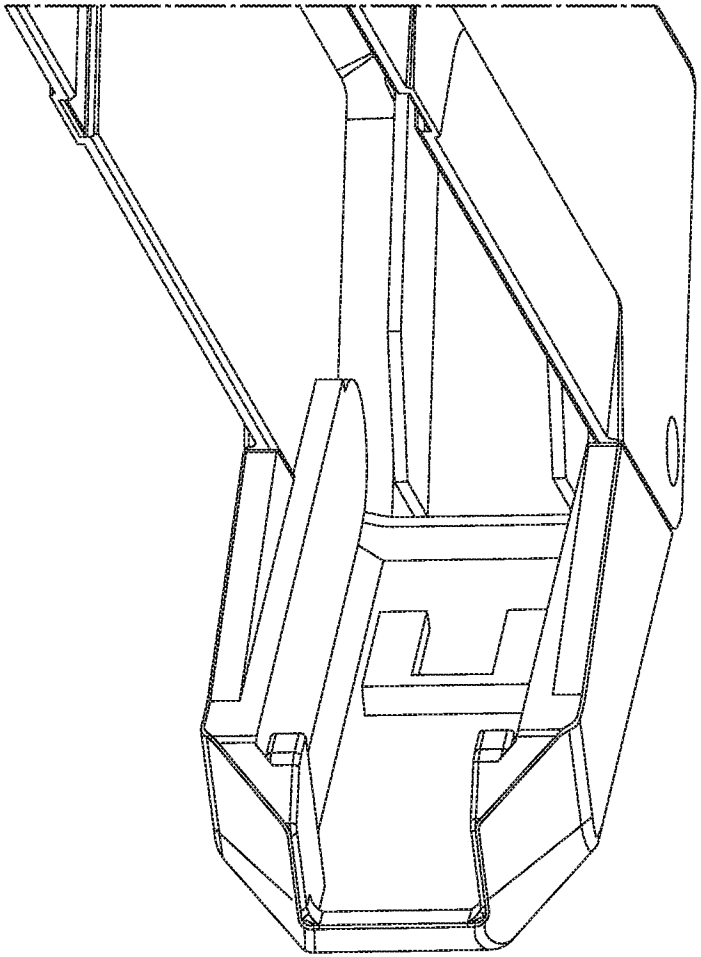
FIG. 22 illustrates a close-up inside view of a first tail of the first embodiment of a foldable firearm in a hinged state.
Figure 23:
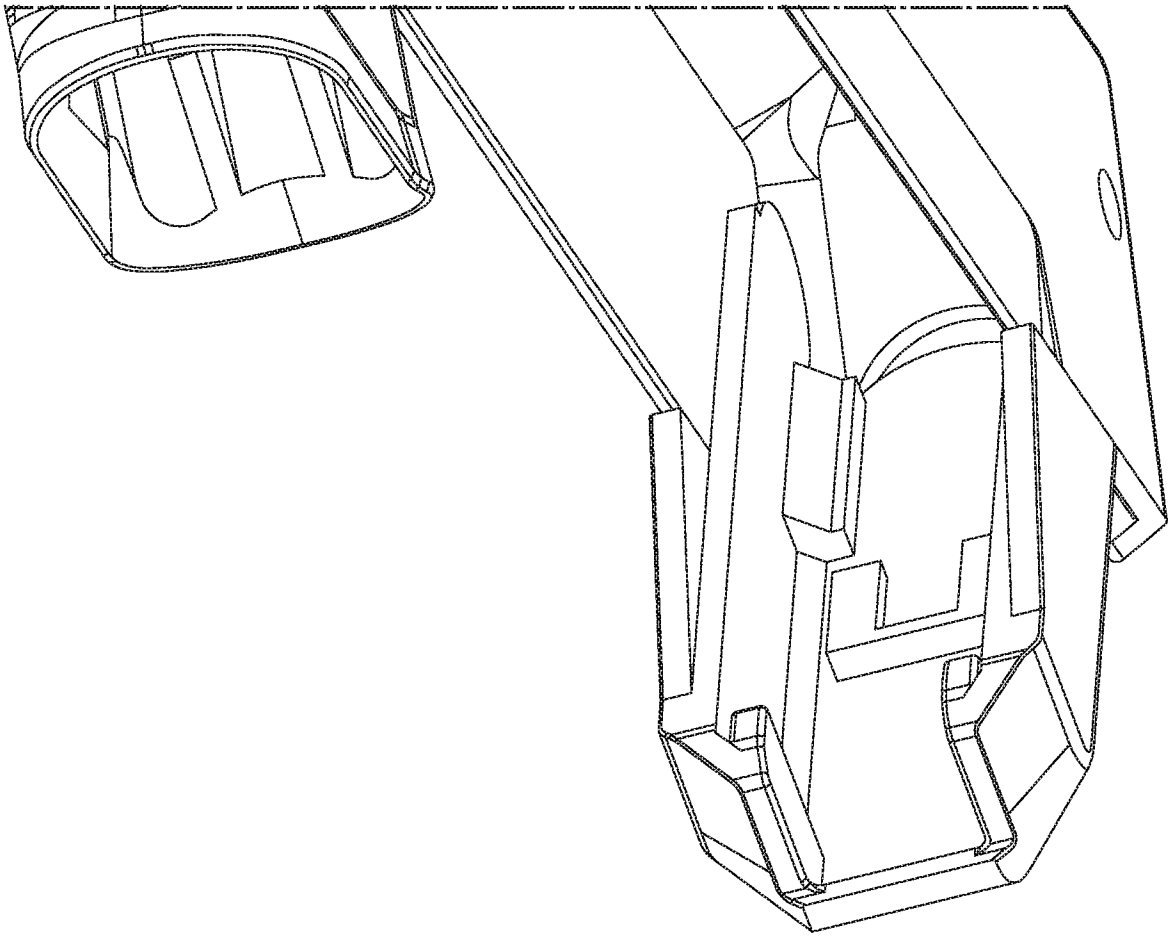
FIG. 23 illustrates a close-up inside view of a second tail of the second embodiment of a foldable firearm in a hinged state.
Figure 24:
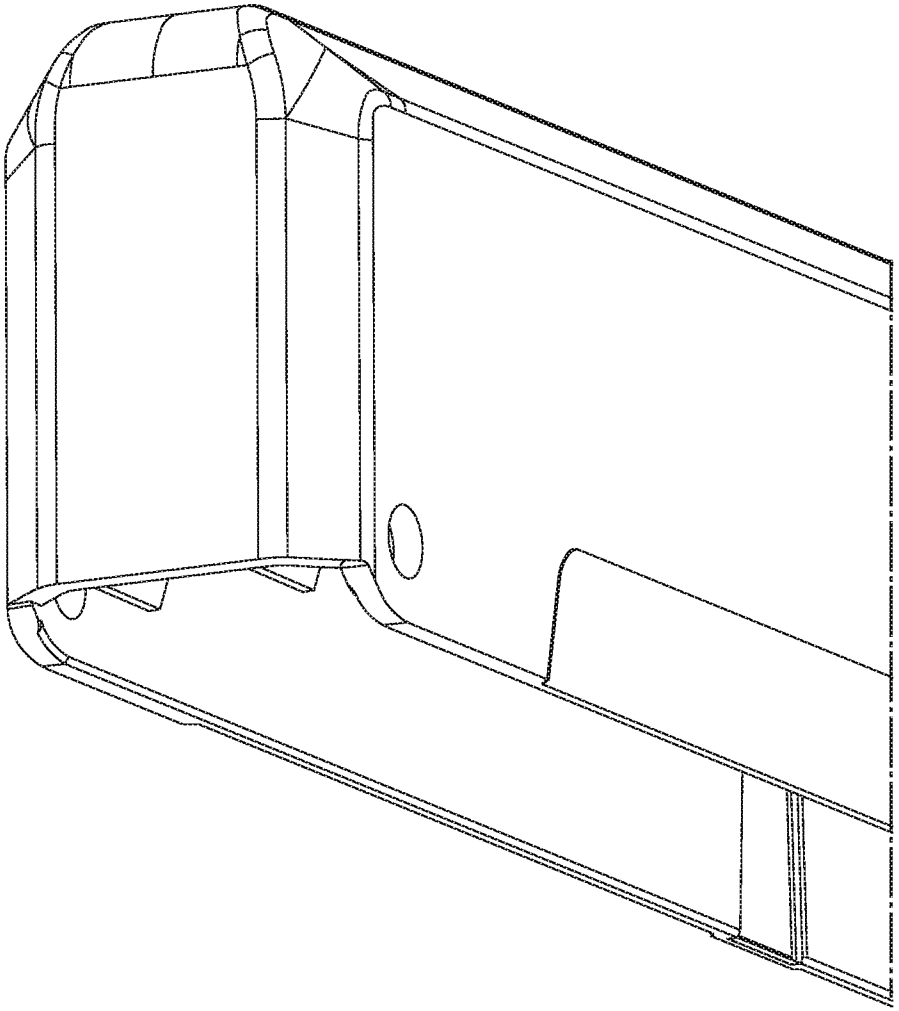
FIG. 24 illustrates a close-up view of the rear of the first embodiment of a foldable firearm with the first tail hidden.
Figure 25:
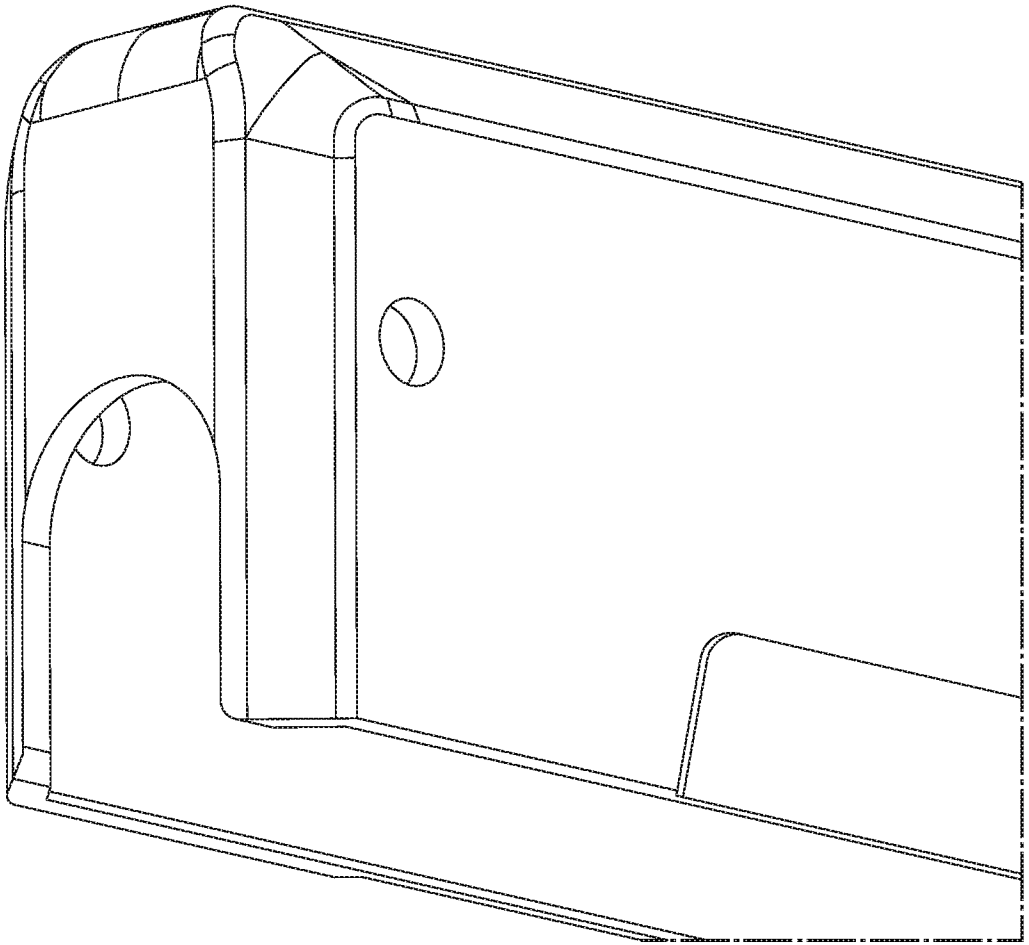
FIG. 25 illustrates a close-up view of the rear of the second embodiment of a foldable firearm with the second tail hidden.

FIG. 15 illustrates an embodiment of a foldable firearm with the first hinged tail, in a folded state, but without a carrying handle.

Figure 29:
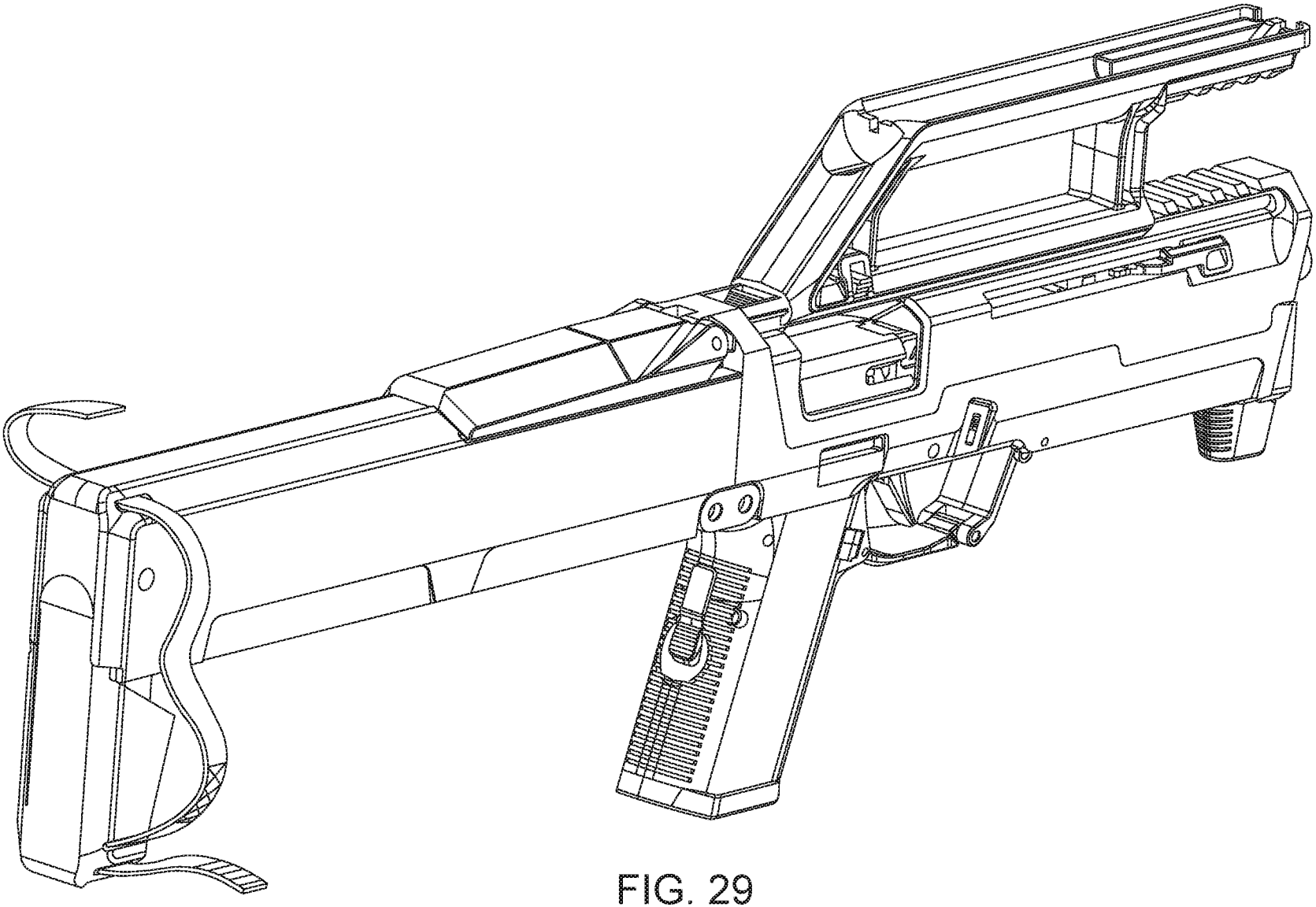
FIG. 29 illustrates a right-side view of a fifth embodiment of a foldable firearm in an unfolded configuration.

FIG. 29 illustrates an embodiment of a foldable firearm with a combination of the second and third hinges, plus an exemplary bracing strap. The bracing strap passes through strap apertures near a bottom of the hinged tail and near a top rear corner of the shell bottom half. The bracing strap can include Velcro or other means to enable the bracing strap to cinch or tie to itself thereby preventing the bracing strap from being pulled out through the strap apertures.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. An ambidextrous charging handle assembly for a foldable firearm, the ambidextrous charging handle assembly comprising:

first and second charging handles arranged on opposing sides of the ambidextrous charging handle assembly, wherein the first and second charging handles are rotatably coupled such that rotation of one charging handle causes rotation of the other charging handle, and wherein movement of either charging handle parallel to a longitudinal axis of the foldable firearm causes the other charging handle to correspondingly move parallel to the longitudinal axis of the foldable firearm; and a slide racking assembly coupled to the first and second charging handles and providing a first vertical pivot axis for the first charging handle and a second vertical pivot axis for the second charging handle, wherein the slide racking assembly is configured to move parallel to the longitudinal axis of the foldable firearm in concert with the first and second charging handles, the slide racking assembly including one or more slide racking detents shaped to engage a slide of the foldable firearm and force the slide to move backward toward a racked position when the first or second charging handle is moved toward a rear of the ambidextrous charging handle assembly.

2. The first and second charging handles of claim 1, wherein the first charging handle comprises a large detent on an upper interface level and a small detent on a lower interface level, the second charging handle comprises a small detent on an upper interface level and a large detent on a lower interface level, wherein:

the large detent of the first charging handle and the small detent of the second charging handle interface when the first charging handle is rotated, thereby causing the second charging handle to rotate to a lesser degree than the first charging handle, or the large detent of the second charging handle and the small detent of the first charging handle interface when the second charging handle is rotated, thereby causing the first charging handle to rotate to a lesser degree than the second charging handle.

3. The first and second charging handles of claim 1, wherein the first charging handle comprises a large detent on an upper interface level and a small detent on a lower interface level, the second charging handle comprises a small detent on an upper interface level and a large detent on a lower interface level, wherein the large detent of the first charging handle and the small detent of the second charging handle interface when either of the charging handles is moved rearward such that both charging handles move rearward in concert, and wherein the large detent of the second charging handle and the small detent of the first charging handle interface when either of the charging handles is moved rearward such that both charging handles move rearward in concert.

4. The slide racking assembly of claim 1, wherein the first charging handle is coupled to a bottom portion of the slide racking assembly by a first pivot nub.

5. The first pivot nub of claim 4, wherein the first pivot nub interfaces with a top portion of the slide racking assembly at a first pivot nub aperture, the interface providing the first vertical pivot axis for the first charging handle.

6. The slide racking assembly of claim 1, wherein the second charging handle is coupled to the bottom portion of the slide racking assembly by a second pivot nub.

7. The second pivot nub of claim 6, wherein the second pivot nub interfaces with the top portion of the slide racking assembly at a second pivot nub aperture, the interface providing the second vertical pivot axis for the second charging handle.

8. The slide racking assembly of claim 1, wherein the bottom portion of the slide racking assembly is coupled to the top portion of the slide racking assembly by a set of forward coupling protrusions of the bottom portion interfacing with a set of forward coupling recessions of the top portion.

9. The slide racking assembly of claim 1, wherein the bottom portion of the slide racking assembly is coupled to the top portion of the slide racking assembly by a set of rear coupling protrusions of the bottom portion interfacing with a set of rear coupling recessions of the top portion.

10. The slide racking assembly of claim 1, wherein the slide racking assembly is constrained to move parallel to the longitudinal axis of the firearm by a guide rail.

11. The guide rail of claim 10, wherein the guide rail is coupled to the firearm, and positioned within a guide rail aperture of the top portion of the slide racking assembly.

12. The ambidextrous charging handle assembly of claim 1, wherein the foldable firearm is converted from a folded to an unfolded configuration by pivoting either the first or second charging handles towards the rear end of the foldable firearm.

13. The ambidextrous charging handle assembly of claim 12, wherein the pivoting of the first charging handle comprises pivoting the first charging handle from a forward-facing orientation to a non-forward-facing orientation less than, or equal to, a perpendicular orientation about the longitudinal axis of the firearm.

14. The ambidextrous charging handle assembly of claim 12, wherein the pivoting of the second charging handle comprises pivoting the second charging handle from a forward-facing orientation to a non-forward-facing orientation less than, or equal to, a perpendicular orientation about the longitudinal axis of the firearm.

15. The slide racking assembly of claim 1, wherein the first charging handle is oriented in a perpendicular orientation about the longitudinal axis of the firearm and the first charging handle is moved towards the rear of the firearm causing the slide to move backwards towards a racked position.

16. The slide racking assembly of claim 1, wherein the second charging handle is oriented in a perpendicular orientation about the longitudinal axis of the firearm and the second charging handle is moved towards the rear of the firearm causing the slide to move backwards towards a racked position.

17. An ambidextrous charging handle assembly for a foldable firearm, the ambidextrous charging handle assembly comprising:

first and second charging handles arranged on opposing sides of the ambidextrous charging handle assembly, wherein the first and second charging handles are rotatably coupled such that rotation of one charging handle causes rotation of the other charging handle, and wherein movement of either charging handle parallel to a longitudinal axis of the foldable firearm causes the other charging handle to correspondingly move parallel to the longitudinal axis of the foldable firearm; and a slide racking assembly for engaging a slide of the foldable firearm, wherein the slide racking assembly is coupled to the first and second charging handles.

18. The ambidextrous charging handle assembly of claim 17, wherein the slide racking assembly provides a first vertical pivot axis for the first charging handle and a second vertical pivot axis for the second charging handle, wherein the slide racking assembly is configured to move parallel to the longitudinal axis of the foldable firearm in concert with the first and second charging handles.

19. The ambidextrous charging handle assembly of claim 17, wherein the slide racking assembly includes one or more slide racking detents shaped to engage the slide of the foldable firearm and force the slide to move backward toward a racked position when the first or second charging handle is moved toward a rear of the ambidextrous charging handle assembly.

20. A method of deploying a foldable firearm comprising:

sliding one of two charging handles backward parallel to a longitudinal axis of the foldable firearm, the two charging handles arranged on opposing sides of an ambidextrous charging handle assembly;

causing the other charging handle to correspondingly slide backward parallel to the longitudinal axis of the foldable firearm via a rotatable coupling between the two charging handles, causing a slide racking assembly coupled to the two charging handles to slide backward parallel to the longitudinal axis of the foldable firearm in concert with the sliding of the first and second charging handles; and causing a slide of the foldable firearm to slide backward toward a racked position via physical contact between the slide racking assembly and the slide.

* * * * *